US005373906A

United States Patent [19]

Braddick

[11] Patent Number: 5,373,906

[45] Date of Patent: Dec. 20, 1994

[54] ORIENTABLE GUIDE ASSEMBLY AND METHOD OF USE

[76] Inventor: Britt O. Braddick, 1038 Martin, Houston, Tex. 77018

[21] Appl. No.: 27,833

[22] Filed: Mar. 8, 1993

[51] Int. Cl.[5] ..... E21B 7/06; E21B 7/18

[52] U.S. Cl. ..... 175/67; 175/61; 175/81

[58] Field of Search ..... 175/61, 62, 67, 73, 175/79, 81, 82; 166/117.5; 299/17

[56] References Cited

U.S. PATENT DOCUMENTS

| | | | |
|---|---|---|---|
| 1,367,042 | 2/1921 | Granville . | |
| 2,258,001 | 10/1941 | Chamberlain . | |
| 2,669,429 | 2/1954 | Zublin . | |
| 2,699,920 | 1/1955 | Zublin | 175/81 |
| 2,797,893 | 7/1957 | McCune et al. . | |
| 3,191,697 | 6/1965 | Haines | 175/81 |
| 3,330,349 | 7/1967 | Owsley et al. . | |
| 3,398,804 | 8/1968 | Holbert | 175/61 |
| 3,994,340 | 11/1976 | Anderson et al. | 166/272 |
| 4,020,901 | 5/1977 | Pisio et al. | 166/50 |
| 4,484,627 | 11/1984 | Perkins | 166/248 |
| 4,497,381 | 2/1985 | Dickinson, III et al. | 175/61 |
| 4,519,455 | 5/1985 | Holtmyer et al. | 166/305 |
| 4,527,639 | 7/1985 | Dickinson, III et al. | 175/61 |
| 4,688,642 | 8/1987 | Baker | 166/382 |
| 4,693,327 | 9/1987 | Dickinson et al. | 175/61 |
| 4,763,734 | 8/1988 | Dickinson et al. | 175/61 |
| 4,886,126 | 12/1989 | Yates, Jr. | 175/4.54 |
| 4,953,636 | 9/1990 | Mohn | 166/65.1 |
| 4,974,672 | 12/1990 | Dickinson et al. | 166/55.1 |
| 5,035,285 | 7/1991 | Dickinson et al. | 166/65.1 |

OTHER PUBLICATIONS

Deep Earth Sampling System William C. Maurer William C. Herben Jun., 1990.

The Ultrashort-Radius Radial System by W. Dickinson, R. R. Anderson & R. W. Dickinson Public Presentation Date Feb. 10, 1986, 8 pages.

*Primary Examiner*—David J. Bagnell

*Attorney, Agent, or Firm*—Jack W. Hayden

[57] ABSTRACT

An anchor (A) or guide assembly (GA) connects with a workstring (WS) that may include a drill string (DS). The guide assembly (GA) includes an internal tubular member (ITM) to releasably connect with the workstring (WS). A tube (CT) is within the internal tubular member (ITM). The internal tubular member (ITM) is releasably secured with an outer tubular member (OTM). The internal tubular member (ITM) is releasably secured with an anchor surface. The workstring (WS) is released from the internal tubular member (ITM) to move relative to the guide assembly (GA) to extend the tube (CT) from the internal tubular member (ITM) for performing various operations. Orienting sub (38) enables operations to be performed at various azimuths and directions from a location, and in this event the outer tubular member (OTM) includes a heel window (58) and a face window (57) and the internal tubular member (ITM) has articulations (55',55") to bend the internal tubular member (ITM) or tube (CT) therein laterally to direct the tube (CT) latterally of a location when the workstring (WS) is lowered.

63 Claims, 7 Drawing Sheets

ORIENTABLE GUIDE ASSEMBLY AND METHOD OF USE

STATEMENT OF THE PRIOR ART

Various types of drilling systems and assemblies have been proposed and employed for earth removal, cutting or drilling. Increased attention is being directed to using other assemblies and systems, such as by way of example only, continuous tubing, commonly called coil tubing, as opposed to standard drill pipe joints that are sequentially threadedly connected together as the drilling or earth removal progresses.

In an attempt to enhance recovery from mineral bearing and oil and gas producing formations, attempts have been made to provide earth removal or drilling systems and assemblies capable of being directed in any direction as well as vertical or horizontal.

SUMMARY OF THE INVENTION

An object of the present invention is to provide a guide assembly which may be non-rotatably and releasably secured, or locked, in position with an anchor surface to perform jetting operations. The jetting operations may be performed, by way of example only, to remove earth for any purpose or reason, or for forming an extension of an existing earth bore in the same direction, or in any desired direction in the earth.

The lateral jetting, or jetting operations to be performed may occur from or laterally through the casing of a main cased earth bore which is large enough to accommodate the necessary equipment and movement of the components to establish a position for drilling laterally relative to the main cased earth bore with fluids, including liquid or gas, and abrasives and at pressures well known to those skilled in the art to cut through the casing in the cased main earth bore and then continue with fluids, and, if necessary, proper cutting materials well known to those skilled in the art, to accomplish what ever jetting of the adjacent earth formation, including rocks and debris is desired.

The jet drilling may also occur in a cavity or enlargement adjacent a cased main earth bore.

Another object is to provide a guide assembly to direct at least one flexible drilling tube with a jet nozzle thereon to any general angle up through and beyond 90 degrees relative to a main cased earth bore by forming a short radius bend in the guide assembly for jetting operations in the earth's formation.

A still further object is to provide a guide assembly for releasably locking with a surface in any location or the surface of an anchor in any location where it is desired to perform jetting operations, or with a well bore casing surface to guide a length of flexible drilling tube in any desired direction up through and beyond a 90 degree short radius turn of less than twelve inches or more than twelve inches.

Another object is to provide a guide assembly for bending a tube having a short radius turn of less than or more than twelve inches to perform a jetting operation, or for any other purpose for any location and in any desired angle of inclination and any desired azimuth.

Yet a further object is to provide a guide assembly of the foregoing type which assembly includes an arrangement to jet drill in any desired direction including, but not limited to one or more lateral directions, angles of inclination and can be locked in position by an anchor to jet drill in any general predetermined desired direction, including lateral directions.

Another object is to provide an arrangement wherein a flexible member or drilling tube enters a guide assembly in generally a vertical direction, exits in a general lateral direction, can be retracted back through the guide assembly, and the guide assembly can be retrieved from the anchor along with the flexible drilling tube.

A further object of the invention is to provide a guide assembly through which a flexible drilling tube or member can be pushed with minimum friction, without crimping the drilling tube or member as it traverses the guide assembly and can be retracted by pulling it back into the guide assembly.

Still another object of the invention is to provide a guide assembly that can be releasably locked with an anchor surface in a cased earth bore to face in any desired azimuth in the cased earth bore, and the guide assembly then formed to guide a flexible member or drilling tube and jet nozzle thereon from the guide assembly in any desired lateral direction relative to a main cased earth bore and to straighten the flexible drilling tube for retrieval from the main cased earth bore along with the guide assembly.

Another object of the invention is to provide a guide assembly that can be oriented in any desired azimuth, releasably locked with an anchor surface in any location to face in a desired azimuth and the guide assembly then formed to guide a flexible member from the guide assembly in a desired direction and to straighten the flexible member for retrieval from the main cased earth bore along with the guide assembly.

Yet another object of the invention is to provide a guide assembly that can be releasably locked in any desired azimuth and the guide assembly then formed to guide a flexible member thereon externally from the guide assembly in any desired lateral direction and/or azimuth to perform an operation in a remote or inaccessible location.

Another object is to accomplish the immediate preceding object and also to retrieve the flexible member.

Another object of the invention is to provide a guide assembly for a flexible drilling tube so that the flexible drilling tube may be bent to exit the guide assembly in any desired direction relative to a main cased earth bore.

A further object is to provide a guide assembly that can be rotated to any predetermined desired azimuth before releasably locking it in position.

Yet still another object of the invention is to provide a guide assembly for bending a flexible drilling tube relative to a main cased earth bore that enables the azimuthal orientation of the guide assembly to be measured with a gyro system or equivalent and then preset at the earth's surface. Yet still another object of the invention is to provide a guide assembly for bending a flexible member that enables the azimuthal orientation of the guide assembly to be measured with a gyro system or equivalent and then preset at the earth's surface.

A further object of the invention is to provide a means for conducting a survey, or a search by visual or oral communication, or to provide air, food, medicine or other substances at a remote or inaccessible location.

Other objects and advantages of the present invention will become more readily apparent from a consideration of the following drawings and description.

Figure 11:
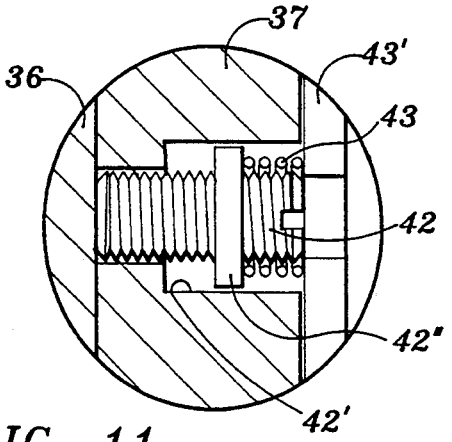
FIG. 11 is an enlarged view of a portion of FIG. 6 to illustrate the position of the spring loaded shear screws of the outer tubular member in running in position of the guide assembly.
Figure 11A:
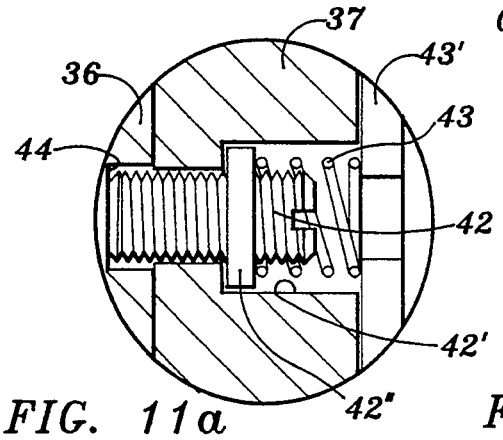
Figure 10:
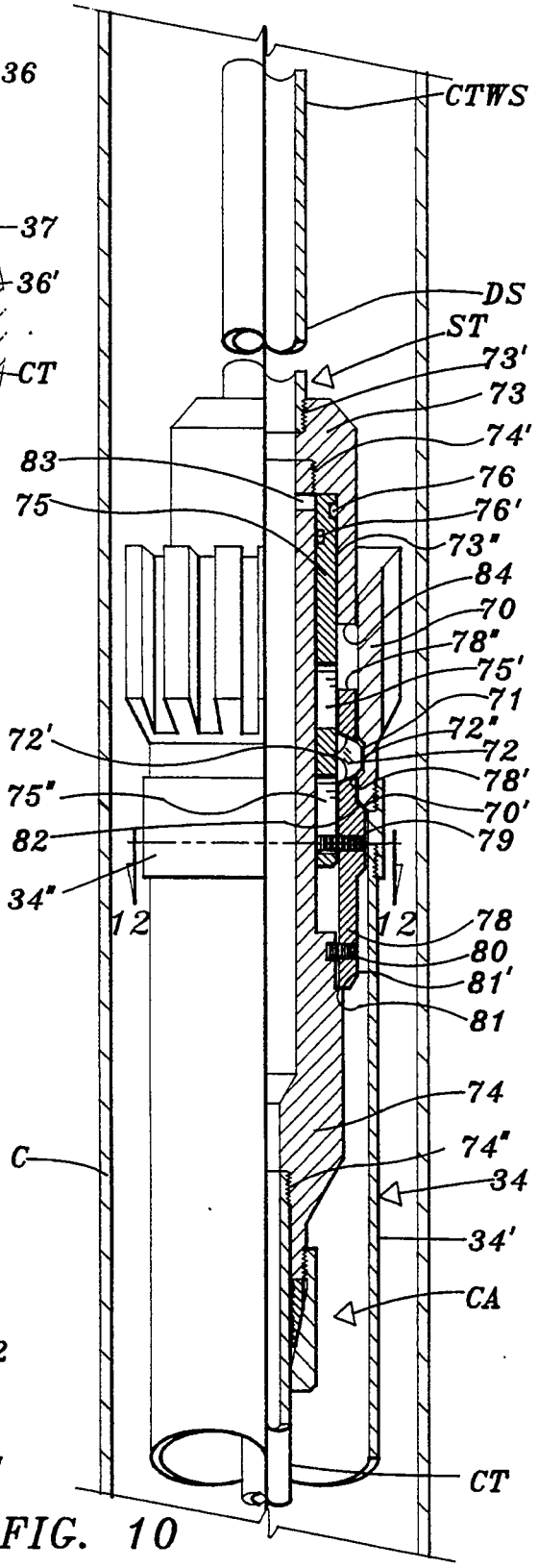
FIG. 10 is a one quarter sectional view of the upper end portion of an alternate form of a combination workstring/drill string that is continuous tubing, commonly called coil tubing and an alternate form of setting collar and setting tool for use therewith.
Figure 12:
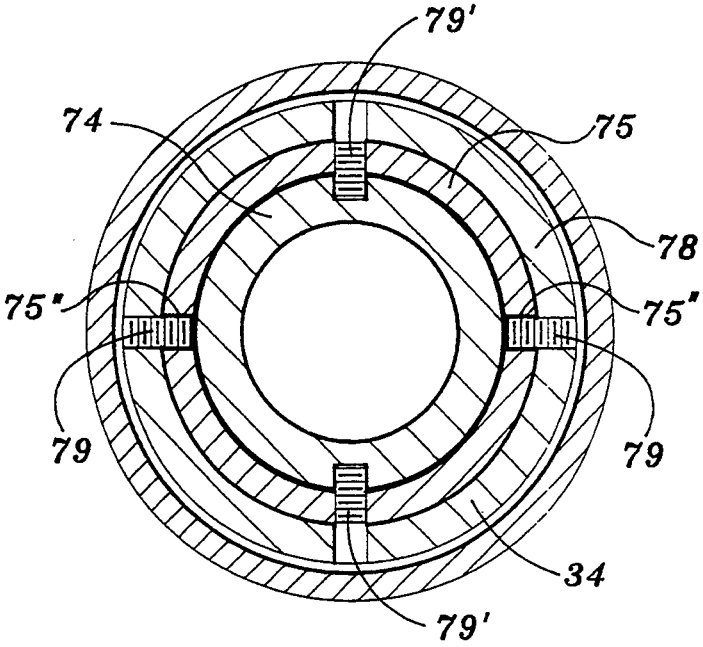
Figure 13:
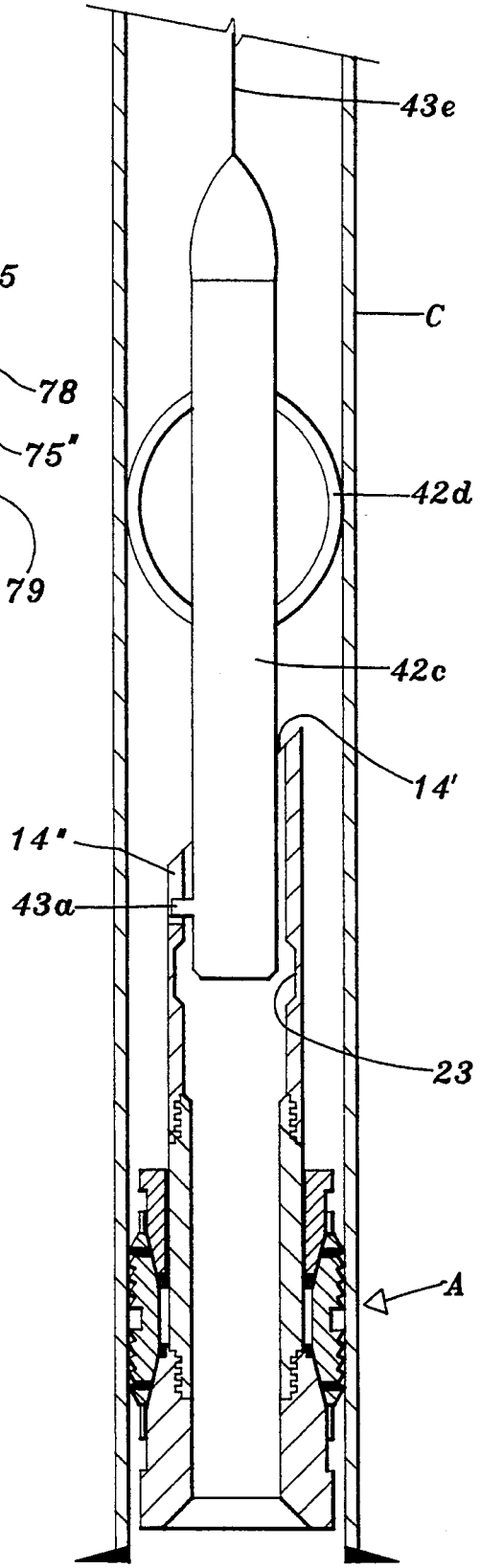

FIG. **11*a* is an enlarged view similar to FIG. 11, illustrating the position of the spring loaded shear screws to releasably lock the internal tubular member with the outer tubular member after the well string has been lowered to form the bend or curved path in the portion 55** of the internal tubular member;

FIG. 12 is a sectional view on the line 12—12 of FIG. 10 illustrating further details of the form of setting collar of FIG. 10 used with a coil tubing workstring/drillstring and the manner of connecting the drilling tube therewith; and FIG. 13 is a sectional schematic view of a survey mechanism, or instrument, for determining the orientation, or direction of a guide assembly latch surface in the anchor for enabling the guide assembly spline sub to be rotated and locked in position at the earth's surface in a predetermined position to face the guide assembly in a desired azimuth when it is positioned and secured in the anchor.

DESCRIPTION OF THE PREFERRED EMBODIMENT

The present invention is described in detail in connection with performing jetting operations, however it may be employed with a flexible member for conducting other operations in locations, or communicating with locations that are remote or difficult to access.

A workstring used to run the guide assembly in a well bore includes a portion termed herein as a drill string.

The term "workstring/drillstring" with regard to the form shown in FIGS. 5–8 inclusive, refers to tubular members connected together by couplings. The term "workstring" or "workstring/drillstring" with regard to the form shown in FIG. 10 refers to a continuous tubing, such as coil tubing.

The workstring/drillstring formed by continuous tubing, such coil tubing, is normally the same outer diameter through out its longitudinal extent. The drill string portion DS of the continuous form of workstring/drillstring is of an outer diameter to permit the drill string portion to pass through the setting collar 70, shown in FIG. 10, of the internal tubular member to move the flexible tube CT or member longitudinally of the guide assembly and outwardly therefrom to perform what ever operations are to be performed after the bend in the internal tubular member is formed.

The drill string portion DS of the tubular member coupled form of worksting/drillstring is connected to the workstring WS and depends therefrom. The drill string portion DS including the couplings thereon, of this workstring WS, is of an outer diameter so that it can pass through the setting collar portion 25, shown in FIG. 5, of the internal tubular member to move the flexible tube CT or member longitudinally of the guide assembly and outwardly therefrom to perform what ever operations are to be performed after the bend in the internal tubular member is formed.

In both forms of workstring/drillstring, the longitudinal extent of the drill string portion DS of the workstring WS is at least the same as the total longitudinal extent of the flexible member or drilling tube CT that is to be exited externally of the guide assembly, including whatever extent is needed to form the bend or curved path in the internal tubular member.

The term "workstring" WS as used herein in the coupled form of workstring or in the continuous form of workstring includes a longitudinally extending drill string portion DS which has the proper outer diameter to pass through the setting collar 25 or 70, depending upon the form of workstring used, and length as above described to manipulate the guide assembly and flexible member to perform the desired operations.

FIG. 10 shows one form of setting collar connected with a workstring/drillstring formed of continuous tubing.

By way of example only, the invention has application in any situation or for any reason where it is desired to conduct operations at or communicate with remote or inaccessible locations such as, by way of example only and not by way of limitation, pollution abatement, waste disposal, rescue operations, displacing earth in construction, mining, mineral search and recovery, enhancing oil and gas production, conducting surveys, conducting substances to or from a remote or inaccessible areas or any other situations where it is desired to communicate with a remote or inaccessible location for any purpose or reason.

The invention is illustrated in some of the drawings with reference to what is generally called a vertical well bore, or a horizontal well bore and is termed a cased main well bore herein. The description of the invention in this regard is by way of example only and not by way of limitation.

By way of example only, the present invention is described in detail for use in performing jetting operations in a main cased earth bore, but it may be used in any application to perform jetting operations.

The use of the term "main cased earth bore" as used herein applies regardless of the inclination, position, azimuth or general direction in the earth of any cased earth bore. Thus, "main cased earth bore" refers to any earth bore having casing whether it is a so called horizontal or so called vertical earth bore or deviated well bore or any other earth bore in which the guide assembly is locked against rotation and from or through which it is desired to accomplish jetting or jet drilling whether it is to drill one or more boreholes laterally of the main cased earth bore in any direction or azimuth, or whether it is desired to accomplish any other jetting operations.

This definition is provided for the example explained in detail herein. Where the jetting operations are employed in situations where there is no earth bore, it can be appreciated that an anchor surface may be provided by a human made anchor surface, or by the terrain in which the invention is employed and with which the present invention may be secured, or an anchor may be provided by any other human made anchor surface, or by the anchor described herein.

For example, well bores in oil and gas terminology are generally referred to as horizontal or vertical, but well bores are seldom, if ever "vertical" or "horizontal" in the strict sense or definition of "vertical" or "horizontal". The use of the terms "vertical" or "horizontal" herein does not mean vertical or horizontal in the strict sense as perpendicular to horizontal, or as perpendicular to vertical, but is intended to reference any boreholes which are provided with casing in which and with which the guide assembly may be non-rotatably secured and from which it is desired to direct or conduct jetting laterally relative to the main cased earth bore.

The invention is described in detail where the workstring/drill string is formed by tubular members coupled together by couplings which normally requires a mast type apparatus such as, by way of example only, a work over rig or other suitable type mast rig to manipulate the workstring/drill string.

The invention is also generally described where the workstring/drill string is a continuous tubular member such as coil tubing which does not require couplings. A coil tubing unit with coil tubing coiled on a drum and extending therefrom and through an injector head, the construction and operation of which is well known to those skilled in the art, is employed to manipulate, or force, the coil tubing workstring/drill string in a manner to operate the present invention and move the drilling tube to perform jetting operations of any type as desired. It is also used to retrieve the drilling tube back into the guide assembly, and to retrieve the guide assembly from the location, such as an anchor in any location the jetting operations are being performed, such as, by way of example only a well bore.

However, the above is by way of illustration only, and any apparatus and manner of manipulating any suitable workstring/drillstring may be employed as desired to position and secure the guide assembly and manipulate the guide assembly of the present invention to perform jetting operations and retrieve it.

Figure 4:
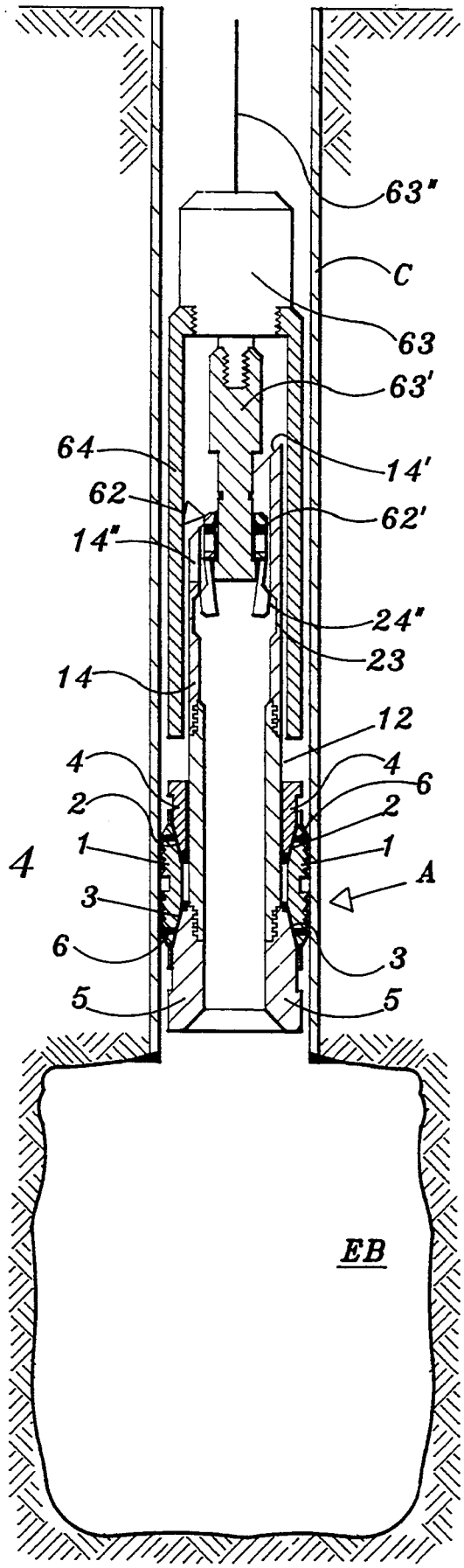
FIG. 4 is a schematic sectional view of one form of an anchor secured in a main cased earth bore.

In FIG. 4 of the drawings an enlarged earth bore EB below a main cased earth bore is shown. An anchor, represented generally at A, is shown secured in the casing C of a well bore in what is generally termed a vertical well bore.

At the earth's surface, a collet latch 62 of any well known form to those skilled in the art is engaged in an anchor surface of any suitable configuration, such as an annular groove 23 within the anchor A in a well known manner. The collet latch is connected by shear pins 62' to an adapter 63' of a hydraulic or wireline setting tool, of any well known type, schematically represented at 63 in FIG. 4. A wireline setting tool is employed in the example described herein.

A hydraulic or wireline setting tool is schematically represented at 63 and is shown in FIG. 4 as lowered on tubing or a wireline, depending upon the type of setting tool used, represented generally at 63". When the setting tool is actuated,the setting adapter sleeve 64, in a manner well known to those skilled in the art, enables the setting tool to set or engage the slips 1 with the casing C and to also release the setting tool 63 and latch 62 from the secured anchor A, as seen in FIG. 4, for retrieval to the earth's surface.

Figure 7:
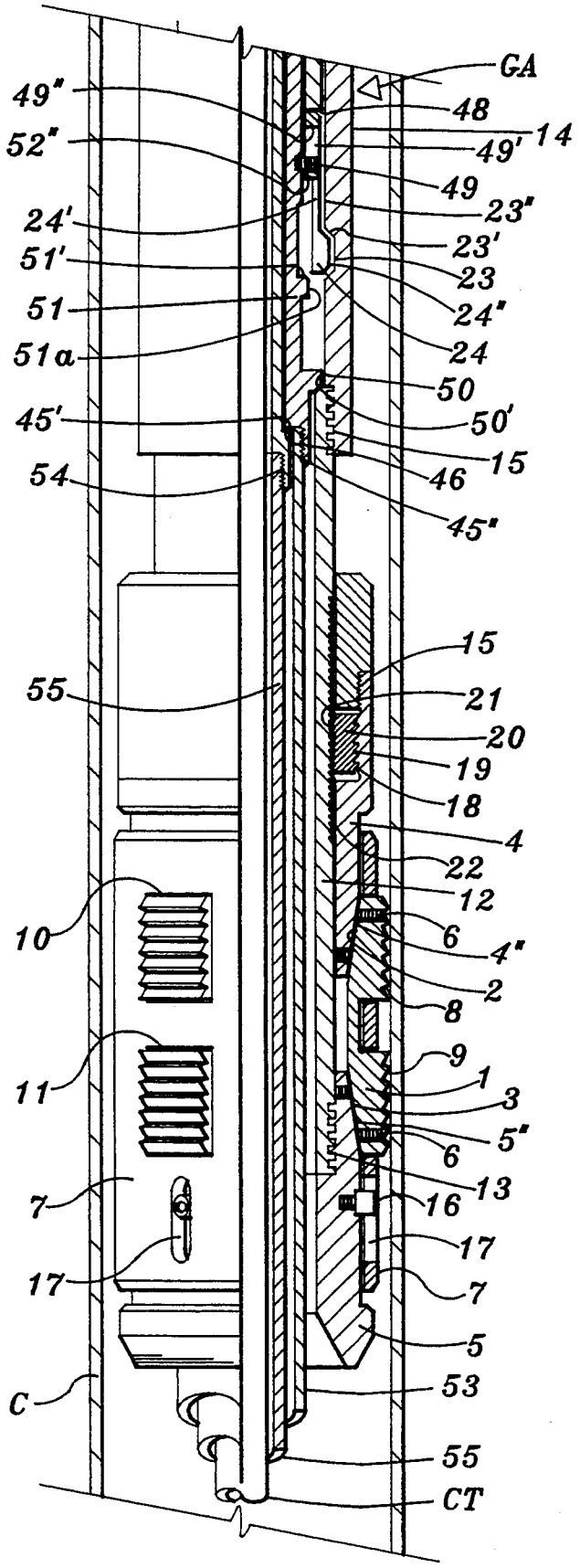
FIG. 7 is a one quarter continuation sectional view of FIG. 6 showing in greater detail the anchor of FIG. 1 secured with the casing of a main cased earth bore with the guide assembly releasably positioned therein against longitudinal movement, and the cooperating shoulders that releasably support the outer tubular member on the internal member.

As seen more clearly in FIG. 7, the slips 1 have internal conical surfaces 2 and 3 and external wickered surfaces or teeth 8 and 9 thereon. Shear screws 6 shown in FIGS. 4 and 7 extend through the conical surfaces 4" and 5" of cone members 4 and 5, respectively and the slips 1 to retain the slips 1 retracted until the anchor A is lowered to the desired location in the casing C.

The slips are contained within cage 7 and are capable of extending into and through cage windows 10 and 11, respectively. The barrel 12 extends internally through the upper cone member 4, slips 1 and cage 7 and is attached to the lower cone member 5 by means of thread 13 at its lower end and is attached to the orientation sleeve 14 by means of threads 15 at its upper end. Lower cone 5 is equipped with cap screws or keys 16 which extend into slots 17 of cage 7. The upper cone 4 contains internal threads 18 to receive loose fitting external threads 19 of split ratchet ring 20. Internal buttress threads 21 of split ratchet ring 20 are positioned externally of barrel 12 in ratcheting engagement or relationship with buttress threads 22 on barrel 12.

When the setting tool 63 is actuated, the adapter sleeve 64 moves the upper cone 4 downward over the barrel 12 and barrel 12 is moved upward by adapter 63'. The split ratchet ring 20 expands, reducing the clearance between the loose fitting internal threads 18 of the upper cone 4 and the external threads 19 of the split ratchet ring 20, permitting the internal buttress thread 21 of the split ratchet ring 20 to pass or ratchet over the external buttress thread 22 of the barrel 12 and then locking upper and lower cones into engagement with the radially expanded slips 1. Since slips 1 are keyed within windows 10 and 11 of cage 7, which is keyed to lower cone 5 by cap screws 16 positioned in cage slots 17, and barrel 12 is threadedly engaged at its lower end to lower cone 5 and at its upper end to orientation sleeve 14, any torsional forces imparted to the orientation sleeve 14 will be imparted to the surface with which it is to be secured. In the example of a cased earth bore, the anchor is secured with casing C, thus preventing relative rotation and longitudinal movement between the orientation sleeve 14 and the casing C.

In one preferred form the anchor is shown as being tubular and includes the orientation sleeve 14 with an inclined or biased upper annular edge surface 14'. A guide assembly latch surface of any suitable configuration such as a longitudinally extending recess or a slot 14" is shown as intersecting the tapered upper edge 14' at the lowermost position thereon.

After Anchor A is positioned in the Casing C, operation of the hydraulic or electric wire line setting tool 63, in a manner well known in the art, moves the orientation sleeve 14, barrel 12 and lower cone 5 in an upward direction while moving the upper cone 4 with ratchet ring 20 in a downward direction, with sufficient force to break shear screws 6, that releasably attach slips 1 to upper cone 4 and lower cone 5. This enables upper and lower cones to move toward one another, further engaging external conical surfaces 4" and 5" of upper cone 4 and lower cone 5, respectively, expanding slips 1 radially through windows 10 and 11 of cage 7 into non-rotational engagement with the internal surface of the Casing C.

The anchor A secured in the casing C of a main cased earth bore is shown in greater detail in FIG. 7 with the guide assembly GA of the present invention releasably positioned therein. The shear screws 6 of the anchor A are shown in FIGS. 4 and 7 as having been broken since the hydraulic, or wireline setting tool, schematically shown at 63 in FIG. 4, has been actuated to set the slips 1 with the casing C to secure the anchor in the cased earth bore and to release the setting tool and latch from the anchor in a manner well known in the art, as shown in FIG. 4.

The foregoing surface arrangement provides one form of a lock arrangement to secure and maintain the guide assembly in the anchor while operations, such as by way of example only, jetting operations are performed. Where the anchor is employed in cased earth bores, the anchor is secured in a predetermined position in the casing C to enable the operations to bend the internal tubular member and drilling tube in any desired angle of inclination from the desired curved path and at any desired azimuth, when desired, to accomplish jetting operations from a main cased earth bore.

After the setting tool 63 is retrieved from the main cased earth bore, the guide assembly GA may be lowered into position therein by the workstring WS.

Internal anchor surface shown in the from of annular groove 23 in FIGS. 4 and 7 formed on the inside diameter of the orientation sleeve 14 serves the dual purpose for releasably securing both the setting adapter collet 62 to set the anchor and to receive the anchoring latch surface 24 of the guide assembly GA with the anchor A.

Both forms of the workstring or workstring/drill string can be used with the guide assembly by releasably connecting with the guide assembly of the present invention, referred to generally by GA. The guide assembly comprises an internal tubular member referred to generally by ITM and an outer tubular member referred to generally by OTM.

A drilling tube CT extends longitudinally within the internal tubular member and is supported by the workstring.

Figure 5:
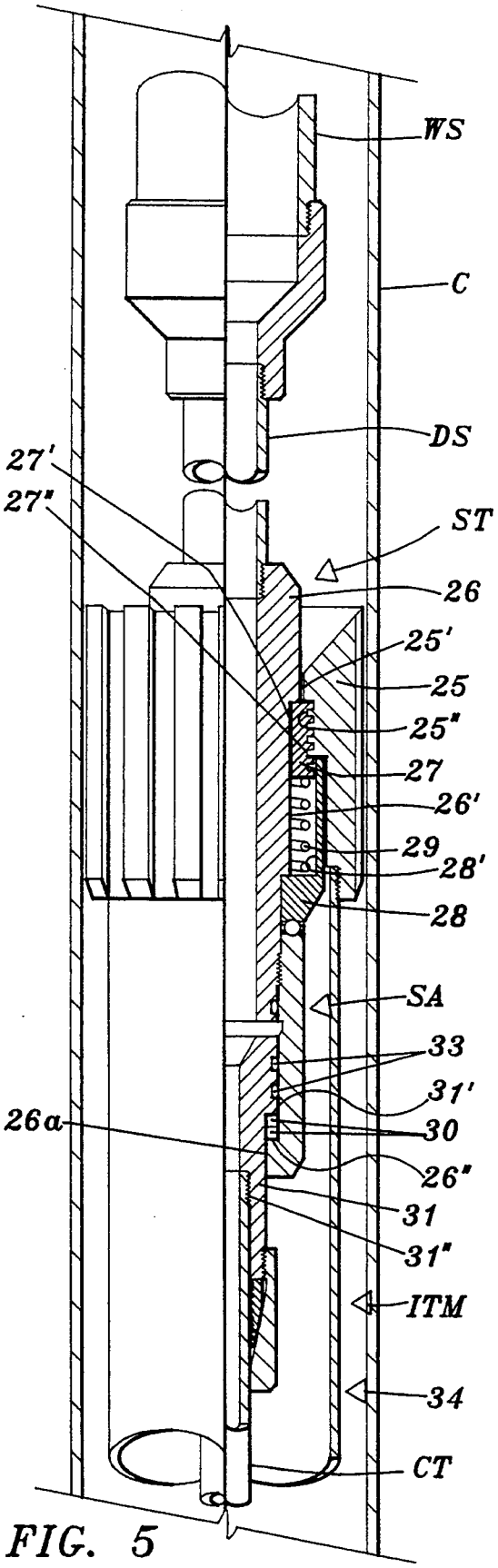
FIG. 5 is one quarter sectional view showing a portion of one form of the workstring/drill string that is standard pipe coupled together and releasably connected to one form of a setting collar secured with and forming the upper end portion of the upper body which is part of the internal tubular member. The swivel arrangement or connection for supporting the drill string rotatably relative to the drilling tube that is connected with the swivel mandrel is also shown.

The above described workstring/drill string is formed of standard tubular members coupled together as illustrated in FIG. 5 with the drillstring portion of the workstring having the length and dimensions referred to herein. The workstring is releasably connected with the setting collar 25 in FIG. 5. A setting collar form as shown in FIG. 10 is for connecting with a workstring/drill string formed of continuous or commonly called coil tubing.

The setting collar of either FIG. 5 or FIG. 10 defines the upper end of the internal tubular member ITM of the guide assembly of the present invention. The function of the workstring with the ordinary coupled drill string portion will be described in detail with the guide assembly of the present invention; however the operation and function of the present invention with the coil tubing form of workstring/drill string is generally the same except as explained hereinafter. For example, the manner of releasing the coil tubing workstring/drill string from its setting collar 70 and the manipulation thereof to actuate the guide assembly is slightly different from the manner of releasing the ordinary pipe and coupling workstring/drill string and manipulating it to actuate the guide assembly, as will be explained in detail. Release of the coil tubing workstring is accomplished without rotating the workstring.

By way of further clarification and not by limitation, the internal tubular member ITM may be considered as comprising: (1) she setting collar 25 forming the upper end of (2) the upper body referred to generally at 34 which upper body is formed by (3) tubular members 34' connected together by couplings 34" with the lowermost coupling connected at its lower end to; (4) connecting member 35 which is connected to the upper end of guide kelly 36 with its lower end being connected to; lower inner tubular member 55; and straightening guide 56 is connected to the lower end of lower inner tubular member 55.

By way of clarification and not by limitation, the outer tubular member OTM that is releasably supported on the shoulder 46 of the internal tubular member may be considered as comprising: spline sub (37) which supports orientation sub (38); latch mandrel (45) which supports at its lower end outer tubular member 53 which has heel window 58 and face window 57.

The workstring WS, where the present invention is employed in connection with a previously drilled or formed cased earth bore, is manipulated, or lowered to secure the outer tubular member OTM that is supported on the ITM in an anchor such as anchor A.

Figure 1:
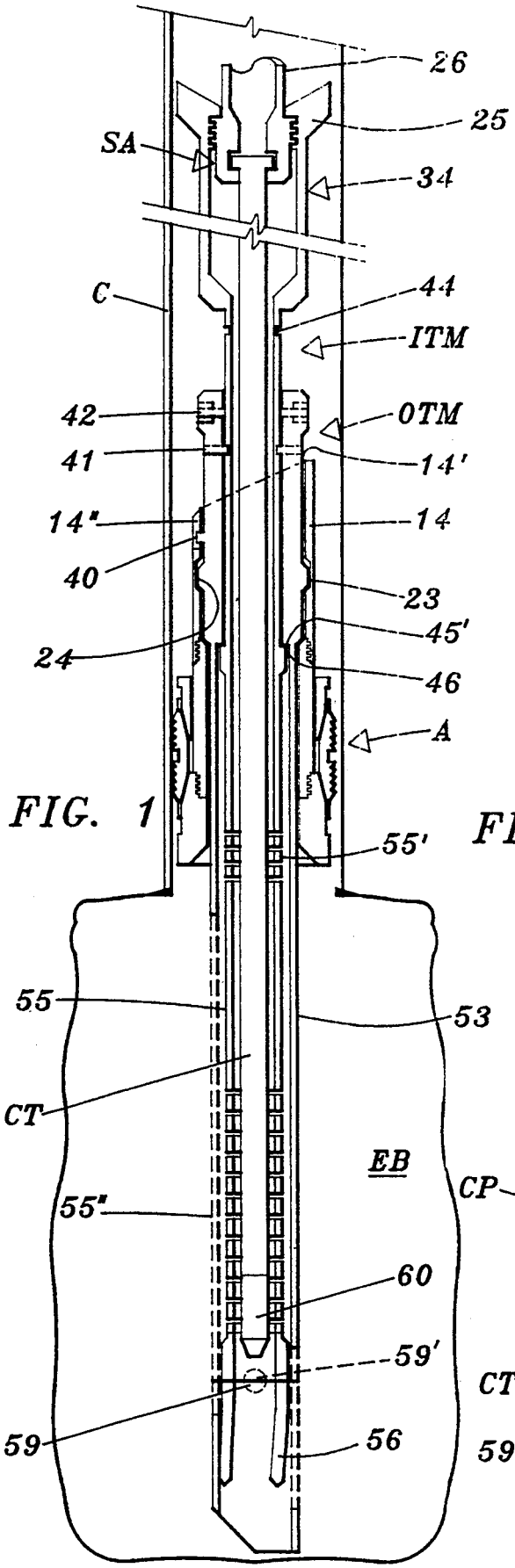
FIG. 1 is a sectional schematic drawing showing one form of the invention connected with a workstring formed by tubular members coupled together and releasably connected together with the internal tubular member of the guide assembly which is secured in an anchor in a main cased earth bore represented as what is generally termed a vertical well bore with a cavity illustrated as an enlarged portion below the cased main well bore.
Figure 2:
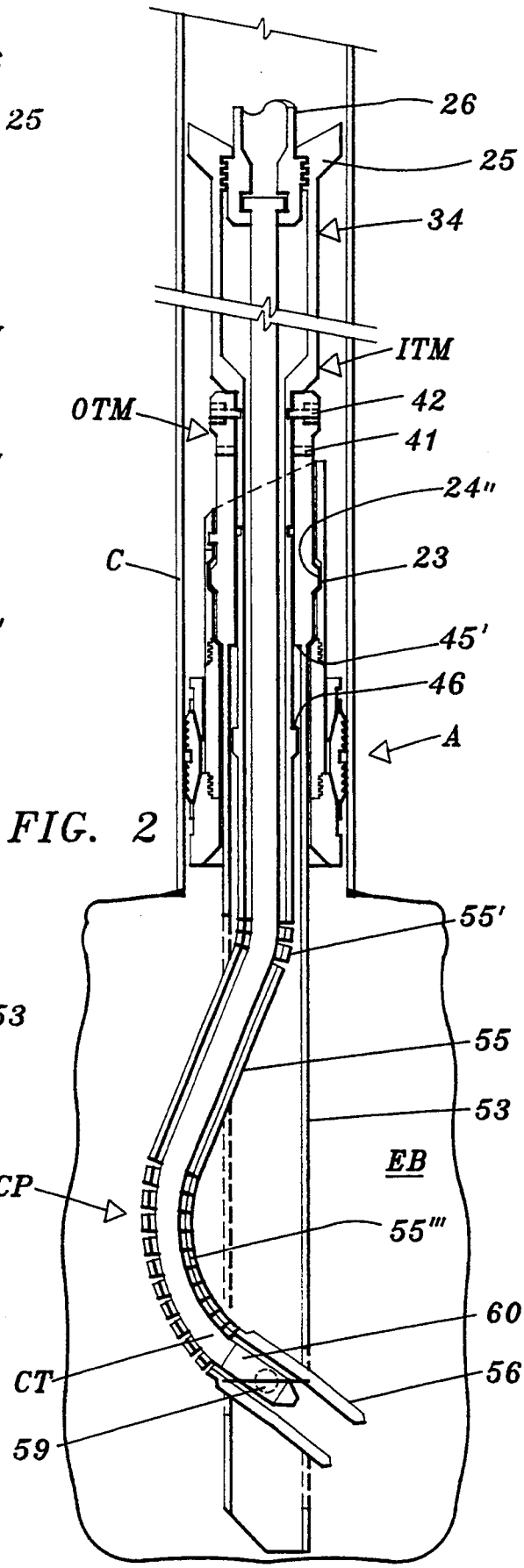
FIG. 2 is a schematic view similar to FIG. 1 showing the connected workstring and internal tubular member lowered relative to the outer tubular member to form a bend or curved path in the internal tubular member with the flexible tube, or member, therein and the internal and external tubular members releasably locked together.
Figure 3:
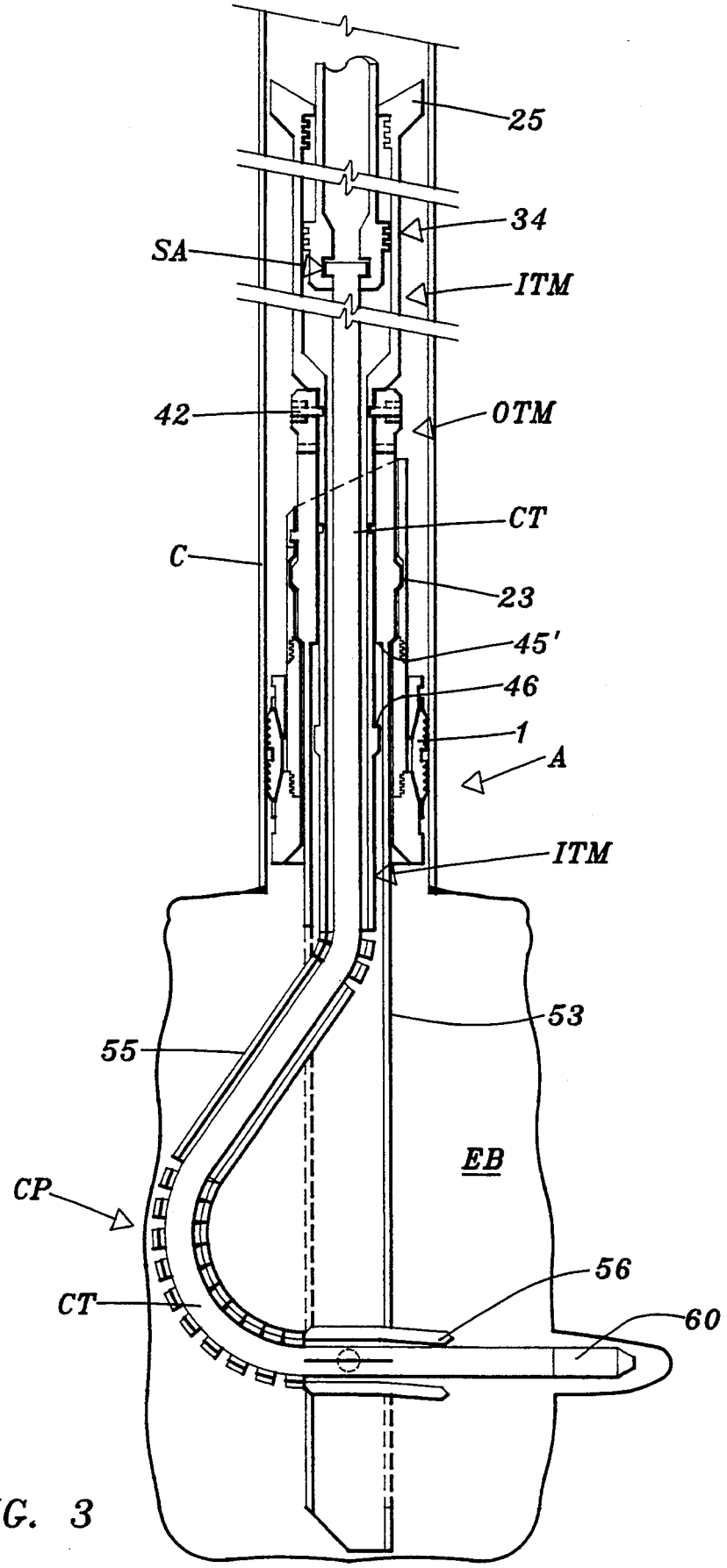
FIG. 3 is a sectional schematic view similar to FIG. 2, showing the workstring released from the internal tubular member and partially moved down to partially exit the flexible tube, or member, through the face window of the the outer tubular member for one type of operation, such as by way of example only, jetting a borehole in an enlarged cavity or under reamed portion adjacent a main cased well bore.

The workstring and internal tubular member ITM with which it is connected by coupling 25 or 70, depending upon which form of workstring/drillstring is used, is then manipulated by lowering to move the internal tubular member downwardly relative to the outer tubular member OTM which separates the ITM from the OTM that is supported, or anchored in the anchor A against longitudinal and rotational movement. This is illustrated by the space that is formed by this movement between the shoulder 45' formed on the outer tubular member and the shoulder 46 formed on the internal tubular member as schematically illustrated in FIGS. 1–3 inclusive.

This downward movement bends the lower inner tubular member 55 of the internal tubular member ITM and drilling tube CT therein to form an arcuate path when it is desired to perform operations, such as by way of example only, jetting, in a main cased earth bore or in a cavity adjacent the main cased earth bore, as will be described.

The arcuate path formed by bending the internal tubular member enables the the drilling tube CT and nozzle 60 thereon to exit at a desired angle of inclination and azimuth, if desired, relative to the main cased earth bore or if the invention is used where the jetting is in other than a main cased earth bore the exit will be relative to the guide assembly, however anchored.

The workstring/drill string is then manipulated to first release from the setting collar and then lowered relative to the ITM and OTM to move the drilling tube CT down and then out from the guide assembly in any angle of inclination and, if desired at any azimuth. Where the guide assembly is to be positioned to exit the drilling tube CT in a desired azimuth, the azimuth of the guide assembly face, comprising the guide assembly face window 57 is preset or predetermined before lowering the guide assembly into the anchor A to accomplish the desired jetting.

As seen in FIGS. 5 and 10 the drill string portion of both workstrings WS include a setting tool portion ST having mandrel 26 threadedly connected with the drill string portion of the workstring WS as illustrated in the drawings. The workstring thus extends through the setting collar 25 as shown in the drawings. The internal diameter of the setting collar is represented at 25' and is always larger than the outside diameter of the workstring, including couplings. The mandrel 26 of the setting tool portion of the drill string is provided with a non-circular exterior surface, or kelleyed portion 26' that is in slidable, non-rotatable engagement with the non-circular bore 27' extending through annular setting nut 27. Setting nut 27 has threads 27'' on its exterior annular surface which engage with the internal threads 25'' in setting collar 25.

Nut housing 28 is carried on mandrel 26 and has an enlarged counter bore 28' adjacent its upper end which is of sufficient diameter to receive setting nut 27 therein, compressing spring 29 when the workstring WS is rotated with clockwise rotation to release from the setting collar 25 form of FIG. 5, without the necessity of lowering workstring WS.

A swivel arrangement referred to generally at SA is shown schematically in FIGS. 1–3 and in FIG. 5 which enables the coupled pipe workstring/drill string to be rotated relative to the setting collar 25 of the internal tubular member ITM for release therefrom without rotating the drilling tube CT which is bent in the lower internal tubular member 55.

The swivel arrangement SA, as shown in detail in FIG. 5 is formed by lower end portion *26a* of mandrel 26 which is connected with the workstring and has internal shoulder 26'' for supporting thrust rings 30, which in turn support the swivel mandrel 31 at external shoulder 31' thereon. Internal threads 31'' adjacent the lower end of the swivel mandrel are provided for securing with the upper end portion of the drilling tube CT, which may be coil tubing, or any other form of suitable flexible conduit.

Swivel mandrel 31 is equipped with seals 33 which provide a fluid pressure tight seal between the setting tool mandrel 26 forming part of the workstring/drill string and swivel mandrel 31, as shown in the drawings.

In FIG. 5, the drilling tube CT is shown threadedly connected to the swivel mandrel 31, and in effect the drilling tube CT is thus connected with the coupled form of workstring/drill string.

Where the FIG. 10 setting collar 70 form is used, the drilling tube CT is also connected with the workstring/drillstring that is formed of a continuous tubular member such as, by way of example only, coil tubing.

The drilling tube CT extends within the internal tubular member ITM and the internal tubular member is pivotally connected with the lower outer tubular member 53 of the OTM adjacent its lower end as will be explained hereinafter.

The above arrangement enables the coupled workstring WS and connected coupled drill string DS to be manipulated, or lowered to bend the lower inner tubular body or member 55 and the drilling tube CT extending there through to position the lower end of the drilling tube, or other type of flexible member in the direction, or at the inclination and/or azimuth desired when it is desired to drill or jet at an angle relative to the anchor, or main cased earth bore.

Thereafter the workstring/drill string may be manipulated to release from the setting collar 25 to move therethrough and lower the drilling tube CT and attached jet nozzle 60 supported thereby laterally of the main cased earth bore and out of the internal tubular member to accomplish jetting or jet drilling as desired and as will be explained hereinafter.

The upper body 34 is formed by a series of tubular members 34' threadedly connected together by couplings 34'' in a manner well known in the art, and is of sufficient internal diameter throughout its longitudinal extent to permit unrestricted downward passage of the drill string portion of the well string WS after release from the setting collar 25 or release from the setting collar 70 where the continuous form of workstring WS is used.

The upper body 34 must also be of sufficient length to contain the length of drilling tube CT which is required to be displaced from the guide assembly, referred to generally at GA, after bending the drilling tube CT laterally of the main cased earth bore to direct the drilling tube and jet nozzle attached therewith and guide assembly to accomplish what ever jet drilling is to be done.

Figure 6:
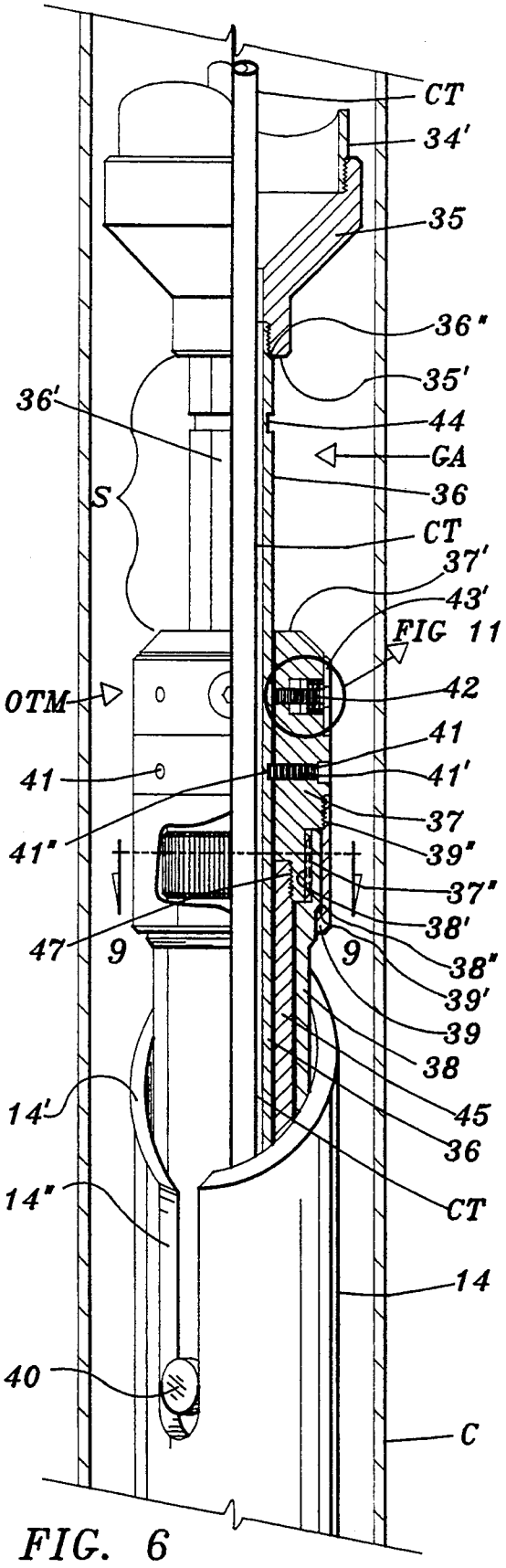
FIG. 6 is a one quarter continuation sectional view of FIG. 5 showing the lower end of one of the tubular members which form the upper body part of the internal tubular member; a suitable connection to form the transition from the upper body to the guide kelly of the internal tubular member; a part of the releasable support for the outer tubular member on the internal tubular member and the outer tubular member releasably and non-rotatably secured with the anchor.

Connecting member 35 in FIG. 6 threadedly connects the lower end of the tubular members 34' forming upper body 34 to the guide kelly 36 which also is part of the internal tubular member ITM. Guide kelly 36 has a non-circular outside portion 36' which extends from shoulder 36'' thereon to a position below spline sub 37 when the guide assembly GA is in its running in position in the main cased earth bore and guide kelly 36 is in its fully extended position. Spline sub 37 is also part of the internal tubular member.

The shoulder 36'' on guide kelly 36 abuts the bottom 35' of connecting member 35 when the guide assembly is in running in position as illustrated in the drawings.

Spline sub 37 has a non-circular bore which mates with the non-circular outside portion 36' of guide kelly 36. The distance between the bottom surface 35' of connecting member 35 and the top surface 37' of spline sub 37 defines the stroke S of the well string WS and drill string DS which bends the internal tubular member ITM and drilling tube therein to direct the drilling tube to exit the internal tubular member in a lateral direction relative to the main cased well bore.

The length of the stroke S is one factor that determines the angle at which the internal tubular member ITM is pointed laterally relative to the main cased earth bore and determines the angle of inclination at which the drilling tube CT laterally exits the internal tubular member and main cased earth bore. The surfaces 35' and 37' provide one form of a cooperating variable arrangement for determining the length of stroke S.

The distance between these two surfaces may be varied to either increase or decrease the angle, or direction, at which the drilling tube CT exits relative to an anchor A, or main cased earth bore. The distance from the surface 35' to the center of groove 44 is always equal to the distance from the surface 37' to the center of spring loaded shear screw 42.

In FIG. 6, the distance of the stroke S in one form of the invention, as described herein, is intended to be 8 and ⅛ inches which forms a bend in the inner tubular member. This length for the guide assembly described herein positions the lower end of the internal tubular member ITM at approximately 90 degrees relative to an anchor or main cased earth bore as shown in FIG. 3. This enables the drilling tube CT and jet nozzle 60 thereon to exit the internal tubular member ITM at an angle which is substantially horizontal relative to the vertical main cased earth bore as illustrated in FIG. 3. It can be appreciated that this length of stroke to accomplish the same angle may vary depending upon the size of components employed in the guide assembly.

Also, where it is desired to exit the drilling tube from the internal tubular member ITM at a different angle of inclination, the length of the stroke S can be changed. If it is desired to exit at an angle less than 90 degrees relative to the guide assembly, the length of the stroke S can be shortened by changing the length of guide kelly 36. This determines the amount of bending that will occur in the inner tubular member 55 of the ITM.

The stroke S can be shortened or increased to decrease or increase, respectively, the amount of bend, or curved path CP in member 55. When the stroke S is shortened, the bend or curved path is formed in the internal tubular member so that the lower end of the internal tubular member is inclined, or points generally downwardly and laterally relative to the main cased well bore. If the stroke is increased, the lower end of the internal tubular member is pivoted upwardly, depending upon the bend, or curved path formed in the internal tubular member. Regardless of the length of the stroke S, the non-rotational relationship between the guide kelly 36 and spline sub 38 is maintained by reason of the mating, non-circular surfaces thereon. Also, the ITM and OTM are locked together by spring loaded shear screws 42 engaged in groove 44 and the abutting relationship of connecting member 35 and spline sub 37 against relative longitudinal and rotational relationship since the OTM is secured in the anchor A against rotation and longitudinal movement relative to the anchor and casing C.

If it is desired to exit the drilling tube CT laterally at an angle in excess of 90 degrees relative to the main cased earth bore, or in this instance, well bore, the length of the stroke S is lengthened to direct the lower end of the internal tubular member ITM upwardly and laterally of the main cased earth bore so the drilling tube CT may exit therefrom in an upward direction above that illustrated in FIG. 3.

In addition to changing the exit angle of the drilling tube from the guide assembly as above described, the exit angle of the coil tubing may also be varied by either repositioning the upper end 57' of face window 57 and the lower end 58'' of window 58, or by changing the degree of reverse angle bend of the straightening guide 56, or by a combination of the above stated procedures.

The size of the components of the present invention may depend upon the application and type of earth formation to be jetted. The drilling tube CT may vary and must be of a size to pass through the components forming the internal tubular member. By way of example only, in one form the drilling tube CT may be 1 and ¼ inches O.D. where a twelve inch radius, approximately, of the bend, or curved path is produced. A one inch O.D. flexible tubing CT will produce a radius of approximately eight inches. Other sizes, of the CT, ITM, OTM, and configuration or design of the articulations may enable the radius to be reduced below eight inches. The components forming the guide assembly must be of size to provide support to the flexible member CT without crimping the flexible member CT as it traverses the guide assembly.

It is also desirable that the bend in the internal tubular member be accomplished in as short a radius as can be developed in a main cased earth bore, or in an adjacent enlarged or under reamed portion and that there be minimum friction of the flexible member, or drilling tube, with no crimping, as it passes through the internal tubular member ITM.

The drill string portion DS is of a length no shorter than the boreholes to be drilled or no shorter than whatever jetting or other operations are to be accomplished.

As previously noted, spline sub 37 forms the upper end of the outer tubular member OTM.

Spline sub 37 has external splines, or surfaces, 37'' on one annular surface thereof spaced circumferentially as desired around the outside circumference of its lower annular end surface as shown in FIG. 6.

An orientation sub 38 also forms part of the outer tubular member OTM. Orientation sub 38 has internal splines, or surfaces, 38' which mate and engage with the external splines 37'' on one annular surface of spline sub 37. Orientation sub 38 has an annular shoulder 38''. A retainer 39 has a retainer shoulder 39' for engaging with orientation sub shoulder 38" and internal threads 39" which engage with external threads on a second annular surface of spline sub 37 as shown in FIG. 6 of the drawings. This enables the orientation sub 38 to be releasably secured in any selected rotated position relative to the guide assembly GA as desired and enables the guide assembly GA to be oriented at the earth's surface so the drilling tube CT may exit from the internal tubular member in any azimuthal direction from the main cased earth bore as desired.

The orientation sub 38 is released from spline sub 37 by removal of retainer 39 and disengaging splines 38' from splines 37". The orientation sub is rotated as desired, the splines 38' thereon engaged with splines 37" and retainer reconnected with the spline sub 37.

By way of example only, FIG. 13 schematically represents a mechanism, or instrument, well known in the art for lowering into a cased main earth bore, such as by way of example only, into a well bore on a wireline as shown to conduct and record a survey that determines the orientation, or direction, of a surface relative to a predetermined direction, such as magnetic North, in a well bore.

A tool is schematically represented at **42*c* with a centralizer thereon represented at 42*d*. The tool 42*c* includes a pin or lug 43*a* that engages in guide assembly latch surface or slot 14" of anchor A which enables the tool 42*c* to determine the orientation of the lug 43*a* which is also the orientation of the guide assembly latch surface 14" of the anchor A. The apparatus is lowered by a wireline 42*e*** into the anchor or A, which is shown schematically, The method of obtaining the survey is well known to those skilled in the art, and no detailed explanation is deemed necessary.

With this information, any person skilled in the art can then disconnect orientating sub 38 from the spline sub 37 and rotate it and reconnect the orientation sub 38 with the spline sub 37 to position the external tubular member of the guide assembly GA so that when the external tubular member is secured in the anchor A, the jetting operations can be conducted in the azimuths as desired.

If it desired to perform operations, such as by way of example only, jetting in more than one azimuth or inclination in a jetting operation such as by way of example in any main cased earth bore, or an adjacent enlarged earth portion the guide assembly GA may be withdrawn from the main cased earth bore and reset and then relowered and the desire bend, or curved path formed as many times as desired.

When the orienting sub 38 is reconnected to the spline sub 37 by the splines, the reconnected guide assembly GA still has the drilling tube CT within the internal tubular member, and the internal tubular member within the external tubular member.

When the guide assembly GA is relowered into the main cased earth bore, the heel window 58 and face window 57 from which the drilling tube CT exits will be in the desired azimuth relative to magnetic North to exit the drilling tube from within the internal tubular member depending upon the position to which the orienting sub has been rotated and then reconnected to the spline sub 37 as above explained. The general angle of inclination or direction at which the drilling tube exits the face window will be determined by the stroke S and the other factors as previously described.

The guide assembly GA is lowered into an anchor A that is secured in a main cased earth bore, or with any surface with which it is desired to secure the anchor for receiving the guide assembly to perform jetting operations.

A latch surface, such as by way of example, lug or key 40 the orientation sub 38 of the outer tubular member OTM engages the upwardly facing tapered or biased edge 14' of the orientation sleeve 14 of the anchor when the guide assembly is lowered into the anchor A which causes the guide assembly GA to rotate and align key 40 for engaging in slot or guide assembly latch surface 14" as shown in FIG. 6. This secures the guide assembly GA in the main cased well bore in the azimuthal direction in which it is desired to jet a lateral well bore, or perform other jetting operations. The key or lug 40 and slot 14" form cooperating surfaces on the guide assembly and anchor A to releasably secure the guide assembly and anchor together against relative rotation. The slot 14" may assume other configurations, such as by way of example only, a longitudinal recess on the internal surface of the orientation sleeve 14 on the anchor.

The foregoing arrangement enables jetting operations to be performed from any location where it may be secured, or secured with an anchor that is secured, such as by way of example only, in a main cased earth bore and in any selected azimuth or angle, or direction, relative to the anchor or relative to the guide assembly.

The foregoing arrangement and method enables the guide assembly to be adjusted at the earth's surface to secure the face window 57 on the outer tubular member OTM in any desired azimuth wherever the jetting operations are to be performed, such as by way of example only, in a cased earth or well bore to enable lateral well bores to be drilled, or jetting operations performed in any selected azimuth. If it is desired to perform jetting operations After the anchor A has been set in a main cased earth or well bore, the above survey run, and the orienting sub 38 of guide assembly GA connected with spline sub 37 in light of the information obtained from the survey, the guide assembly GA is run into a main cased earth bore on a workstring/drill string as shown in the drawings. A latch surface in the form of lug 40 on orienting sub 38 is engaged with the guide assembly latch surface 14" in the anchor A, and latch 24 releasably secures the guide assembly GA with the anchor A. This arrangement releasably locks the guide assembly against rotation and against longitudinal movement relative to the anchor which in turn is locked to the casing C. This secures the guide assembly so that the drilling tube and jet nozzle 60 thereon will exit from the internal tubular member in the azimuth and at the angle, or direction in which it is desired to jet drill or perform jetting operations from the main cased earth bore.

A latch mandrel 45 is connected to spline sub 37 by threads thereon which engage with threads on a third annular surface of said spline sub to form a threaded connection 47, as shown in the drawings. The latch mandrel forms part of the outer tubular member OTM. The latch mandrel extends internally through the orientation sub 38 and carries latch body 24 which abuts the lower end 48 of orientation sub 38 as seen in FIG. 7 of the drawings. Latch body 24 is releasably retained on latch mandrel 45 by shear screws 49, which are threadedly attached to latch mandrel 45 and extend through slots 49' of latch 24. Latch body 24 has longitudinally extending, circumferentially spaced flexible finger-like members 24' which flex inwardly upon entering the bore of orientation sleeve or sub 14 on the anchor A.

This permits the enlarged ends 24" on members 24' to enter the smaller bore 23" of orientation sleeve 14 of the anchor A when a downward force is applied to the guide assembly GA to land or seat the guide assembly in the anchor A as locator shoulder 50 of latch mandrel 45 contacts stop shoulder 50' of the anchor. The enlarged ends, or latch surface 24" of members 24' flex outwardly to their normal configuration when aligned to engage in anchor surface 23, shown as an annular groove in the anchor to secure the guide assembly in the anchor A. In normal use, the enlarged end 24" of members 24' of latch body 24 will engage the upper biased shoulder 23' of anchor latch surface shown as annular groove 23 to retain the latch 24 if the latch mandrel moves upward relative to latch 24. Also, enlarged annular ring 51 of latch mandrel 45 also moves up and is positioned inside and adjacent the enlarged ends 24" of members 24'. The outer annular surface 51*a* of ring 51 provides a first surface on the latch mandrel of guide assembly that prevents inward flexing of members 24' and keeps enlarged ends 24" within anchor surface 23 of the anchor, thus releasably locking guide assembly GA to anchor A against longitudinal movement to inhibit premature release of the guide assembly.

After the jetting operation is completed, or when it is desired for any reason to remove the guide assembly from the location where the jetting operations are performed, by way of example only and not limitation, a main cased earth bore, an upward pull on the workstring and drill string moves the guide assembly upward until shear screws 49 contact the upper end 49" of slots 49' in latch 24. Application of sufficient tensional forces to the workstring WS will break shear screws 49 across slot end 49" as latch mandrel 45 moves upward relative to latch 24. This movement raises enlarged ring 51 of latch mandrel 45 from its locking position adjacent the enlarged end 24", of flexible finger-like projections, or members 24' to a position so that upper shoulder 51' of enlarged ring 51 contacts shoulder 52" of latch 24, which permits inward flexing of members 24' and retraction of latch 24 from engagement with the anchor surface annular groove 23. Shoulder 51' is a second surface on the guide assembly for retrieving the latch 24 with the guide assembly as it is removed from the anchor.

When the guide assembly is in running in position, shear screw(s) 41 in spline sub 37 are contained in threaded hole(s) 417 of spline sub 37, as shown in FIG. 6 and fitted into groove 41" in guide kelly 36 to maintain the stroke S of the guide kelly in its fully extended position. Spline sub 37 has a series of spring loaded shear screws 42 contained in counter bored holes 42' located around the circumference of the spline sub 37 above the shear screw(s) 41. Spring loaded shear screws 42 are threaded onto washer 42" on which compression springs 43 seat as the latter are compressed within counter bored holes 42' and retained in said compressed position by annular spring sleeve 43' which is releasably secured on spline sub 37 by any suitable means such as screws or the like.

When shear screw(s) 41 are sheared and the guide kelly fully collapsed by downward manipulation of the workstring, connector shoulder 35' contacts spline sub shoulder 37', and spring loaded shear screws 42 are aligned with and urged into groove 44 of guide kelly 36 by compression springs 43, releasably locking the guide kelly 36 in fully collapsed position. This prevents relative longitudinal movement between the internal tubular member and the outer tubular member.

The non-circular surface on the kelly and the mating non-circular opening in the spline sub prevent relative rotation between the internal and outer tubular members.

The previously described locking relationship and the above lock the internal tubular member ITM in position in the outer tubular member OTM and maintains the drilling tube CT therein in the bent or curved path position for subsequent exiting of the drilling tube CT and subsequent extension of the drilling tube CT from the guide assembly at the angle of inclination and azimuth desired as determined by the factors previously stated.

In the running in position of guide assembly GA, spline sub 37, retainer 39, orientation sub 38 and latch mandrel 45 are supported by downward facing shoulder 45' of latch mandrel 45 that is supported on upper facing shoulder 46 of guide kelly 36. Also, supported by the upward facing shoulder 46 is the lower outer body 53 which is a tubular element attached to latch mandrel 45 by means of threaded connection 45'.

As seen in FIG. 7, lower inner tubular member or body 55 is threadedly attached adjacent its upper end 54 to and supported by the guide kelly 36. It forms part of the internal tubular member ITM. The lower inner body 55 extends into lower outer body 53, and threadedly connects at 56' to the top end of the straightening guide 56 which forms part of the internal tubular member ITM.

Figure 8:
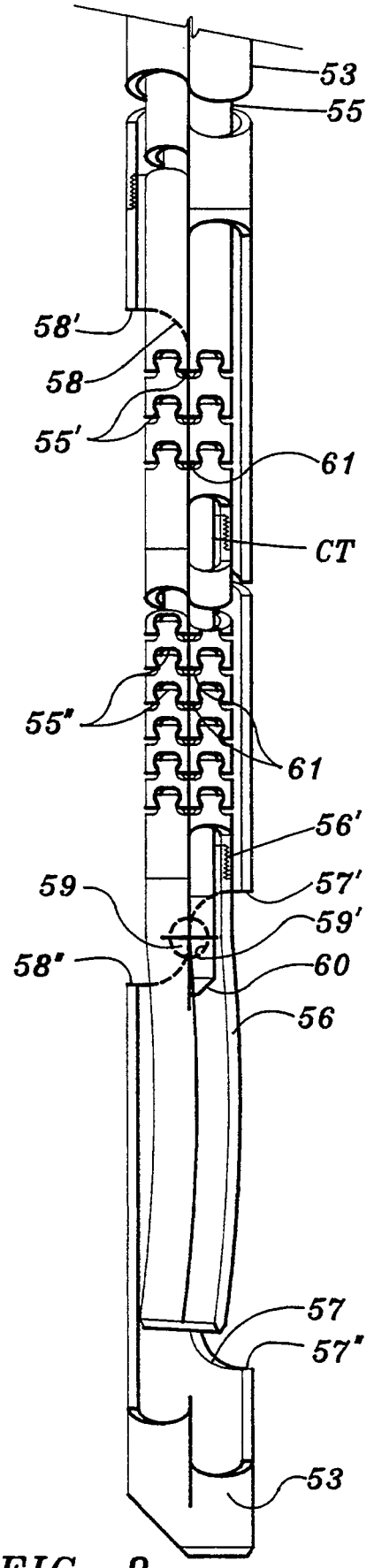
FIG. 8 is a continuation view from FIG. 7, partially in section and partially in elevation showing the outer and internal tubular members pivotally connected together with the flexible tube extending through the lower end portion of the internal tubular member with one form of articulations and one form of straightening guide and jetting head on the internal tubular member. One form of heel and face windows in the lower body of the outer tubular member of the guide assembly is shown.
Figure 9:
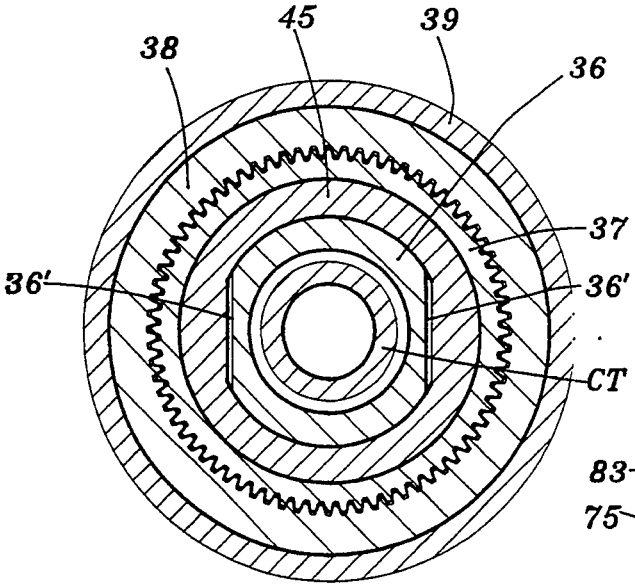
FIG. 9 is an enlarged sectional view on the line 9—9 of FIG. 6 which shows in greater detail one form of the cooperating surfaces on the spline sub to enable the orientation sub of the outer tubular member to be disconnected from the internal tubular member and rotated to a predetermined position and then reconnected with the spline sub at the earth's surface to secure the guide assembly in a desired rotated position so the drilling tube exits the outer tubular member in a desired azimuth when the guide assembly is releasably secured with the anchor.

As seen in FIG. 8, the face window 57 and heel window 58 in lower body 53 are located on opposite sides of the lower end portion of the lower outer tubular body 53 and are of sufficient size to permit passage of the straightening guide 56 and the lower inner tubular member 55. Both face window 57 and heel window 58 are positioned on lower member 53 so as to be adjacent and preferably within the enlarged borehole EB which, by way of example only, is shown as being below the casing C when Guide Assembly GA is landed in the Anchor A.

The straightening guide 56 is a tubular member having an internal passage which is bent or angled so as to reverse bend and straighten the drilling tube CT passing or forced therethrough. In addition to being threadedly connected at 56' at its upper end to the inner tubular member 55, the straightening guide 56 is affixed with two (2) pivot pins 59, located 180 degrees apart on the centerline or plane of the bend of said straightening guide 56. The pivot pins 59 extend outward from said straightening guide 56 and are contained in mated openings 59' positioned in the lower body 53 at a point equadistance from the top end 57' of face window 57 and the bottom end 58" of heel window 58 and at a point 90 degrees radially from said windows.

The inner tubular member 55 of the ITM is shown as having two sets of articulations; however the articulations may be continuous, and of a sufficient extent to accomplish the bend desired. Articulation, as well known to those skilled in the art, is a process in which a tubular member is cut through its wall thickness around its circumference with a design which maintains the tubular member in separate but interlocked components affording the tubular member a degree of flexibility.

The upper articulation set 55' is located at a point below but near the top end 58' of heel window 58 when the inner tubular member 55 is installed within the lower body 53, and the lower articulation set 55" is located at a point immediately above the straightening guide 56 and above the bottom end 58" of heel window 58.

In the running in position, the drilling tube CT extends internally through the guide assembly GA from its point of attachment 31" at the swivel mandrel 31 to the point of termination inside the straightening guide 56 where it is fitted to the jet nozzle 60 on the lower end thereof.

The positioning of the inner tubular member 55 inside of the lower inner body 53 with articulations of suitable form and extent, such as by way of example only and not by way of limitation, articulated sets 55' and 55" as shown in the drawings adjacent the heel window 58 and the lower end of said inner tubular member 55 being attached to the straightening guide 56 which is attached to the lower body 53 by means of the pivot pins 59 will permit the straightening guide 56 to pivot and pass through the face window 57 when a downward force is applied to the workstring WS after the guide assembly GA is seated in the anchor A.

Application of sufficient downward force on the workstring and connected internal tubular member ITM will break shear screws 41 contained in the orientation sub 37 allowing the ITM including the guide kelly 36 and the other components herein above identified including lower inner tubular member 55 to move downward relative to the OTM including lower body 53, which is connected to the latch mandrel 45 that is seated on the Anchor A, causing the inner tubular member 55, between the sets of articulations 55' and 55", to exit the lower body 53 through the heel window 58, as the straightening guide 57 pivots on the pivot pins 59, to exit the lower body 53 through the face window 57, bending the drilling tube CT within said inner tubular member 55 away from the lower body 53 at the upper set of articulations 55' and back toward the lower body 53 at the lower set of articulations 55". FIGS. 2 and 3 illustrate the bent portion of the internal tubular member which form the curved path, represented by CP in the drawings.

The preceding described operation will compress the gaps 61 in the sets of articulations 55' and 55" in the inner tubular member 55 and position the straightening guide 56 at an angle of approximately 45 to 55 degrees from the somewhat vertical position of the lower body 53.

The workstring is then rotated clockwise a sufficient number of turns to disengage the setting nut 27 on the work string from the setting collar 25. The drilling tube CT which is bent inside the inner tubular member 55 is not rotated during the above described operation by virtue of the swivel arrangement which accommodates relative rotation of the workstring and setting tool relative to the swivel arrangement and drilling tube below the setting tool ST that is supported on the workstring.

Release of the setting tool portion ST of the drill string portion DS from the setting collar 25 that forms the upper end of the ITM allows the workstring to be manipulated to lower it and the drill string DS of the workstring to pass through the opening 25' of the setting collar 25. The workstring and drill string continue to move longitudinally relative to the bent ITM including the upper body 34 and displaces the drilling tube CT supported on the workstring WS along with the nozzle 60 on the lower end of the coil tubing from the bent internal tubular member as the workstring is lowered relative to the guide assembly.

Displacement of the drilling tube CT from the upper body 34 forces the drilling tube through the interior of the remaining lower section of the guide assembly GA, including the redirected articulated inner tubular member 55 and straightening guide 56. The frictional forces developed as the drilling tube CT is forced through the redirected articulated inner tubular member 55 causes the articulation gaps 61 to expand or extend out lengthening said inner tubular member 55 and causing straighten guide 56 to further pivot on pivot pins 59 increasing the angle between said straightening guide 56 and lower body 53 to approximately 90 degrees at which point straightening guide 56 will contact the upper end 57' of face window 57 and the lower end 58" of heel window 58, thus terminating the increase of the angle between the straightening guide 56 and the lower body 53, as more clearly sen in FIG. 3 of the drawings.

The stresses imparted to the drilling tube CT in forcing it through the redirected articulated inner tubular member 55 may cause the drilling tube CT to continue bending upward and in a curved arc after exiting a member similar to the straightening guide 56, but without the latter's reverse bend. The reverse bend of the straightening guide 56, creates opposing stresses in the drilling tube CT after the latter traverses the lower set of articulations 55" of the inner tubular member 55, permitting the drilling tube CT to exit the straightening guide 56 and move into the earth's formation and direct the washing action of pressurized fluid released from the workstring WS and drilling tube CT through the jet nozzle 60, to form a lateral horizontal borehole perpendicular, or otherwise laterally relative to the guide assembly GA.

Upon completion of the lateral boreholes or whatever jetting operations are performed, the workstring/drill string WS is raised pulling the drilling tube CT out of the completed borehole, or other jetting operations and back inside the guide assembly GA which is latched into the anchor A by means of latch 24 engaging guide assembly latch surface or groove 23 of orientation sleeve 14 as previously described.

Continued upward movement of the workstring WS under sufficient force will break spring loaded shear screws 42 positioned in groove 44 of guide kelly 36 allowing the internal tubular member ITM, including the guide kelly 36, to be raised from its previous position abutting the spline sub 37 and extending the stroke S of the guide kelly 36 to its full running position length. This causes the inner tubular member 55 and the straightening guide 56 to re-enter the heel window 58 and face window 57 respectively, of the lower body 53 after which upper facing shoulder 46 of guide kelly 36 contacts the downward facing shoulder 45' of latch mandrel 45.

Further increased upward force applied to the workstring WS will raise latch mandrel 45 from it seated position in the anchor A, breaking shear screws 49, releasing the latch 23 from latching engagement with the anchor A as previously described. Continued upward movement of the workstring WS will remove the latter and the guide assembly GA from the casing C.

After removal of the guide assembly GA from the casing C, the former may be re-oriented, as previously described, the setting tool ST forming part of the workstring re-engaged to the setting collar 25, all shear screws replaced to their original positions and the guide assembly GA run back into the casing C of the same or another main cased earth bore and engaged in an anchor A to form additional lateral horizontal boreholes, or perform whatever jetting operations may be desired as previously described, at different azimuths as previously described, or at different angles by adjusting the stroke S, or as previously described.

The length of the lower body 53, inner tubular member 55 and drilling tube CT extending through said inner tubular member 55, may also be increased or decreased between shoulder 50 of latch mandrel 45 and pivot pins 59 to facilitate formation of lateral horizontal boreholes, or performing any other jetting operations or applications of any type and at any location at varying elevations including by way of example only in a main cased earth bore or within an enlarged borehole EB.

FIG. 10 illustrates a setting collar form for use with a workstring/drill string generally referred to as CTWS in FIG. 10 which is formed by continuous tubing, one form of which may be coil tubing from a coil tubing unit releasably connected with a setting collar 70. The setting collar 70 is actuated hydraulically, or may be actuated mechanically, as will be described, to release the continuous workstring CTWS.

The continuous tubing workstring/drillstring is manipulated by any means and in any manner well known in the art as previously stated herein.

The use of a coil tubing to function as a workstring/-drillstring requires the use of a setting tool and setting collar configuration which precludes rotation of the workstring/drillstring to effect disengagement of the setting tool and workstring/drill string from the setting collar, since a coil tubing cannot be rotated.

Where the present invention is employed with a coil tubing workstring/drillstring the structure and operation is generally the same as the conventional coupled pipe workstring/drill string version described heretofore with the exception of the setting collar and setting tool areas and the use of a coil tubing workstring/drillstring CTWS in place of the coupled pipe workstring WS and the drill string DS heretofore described.

The setting collar 70 forms the upper end of the upper body 34 and is threadedly engaged at its lower end to the top coupling, represented at 34" of the the upper body 34. Setting collar 70 performs generally the same function as seting collar 25.

Setting collar 70 is a tubular member with an internal annular groove 71 to receive dogs 72 of the setting tool ST when the latter is assembled in the running position. Dogs 72 have upper and lower edges 72' which taper toward one another at their external surfaces 72". Dogs 72 extend into and through windows 78' of cage 78, the windows 78' having tapered upper and lower edges conforming to those of the dogs which limit the extent to which dogs 72 may extend through windows 78'.

The cage 78 has an annular shoulder 82 which abuts the lower shoulder 70' on the lower end of the setting collar 70 and is supported at its lower end 81' by and carried on shoulder 81 of the setting tool tubular mandrel 74. Cage 78 is also releasably attached to tubular mandrel 74 by shear screws 80. The upper end of the tubular mandrel 74 is connected to the tubular bushing 73 by means of a threaded connection 74'. The tubular bushing 73 is furnished with means well known in the art, such as threaded connection 73', for connection to the coil tubing workstring CTWS.

The tubular bushing 73 has an enlarged counterbore 73" adjacent its lower end which receives the piston dog retainer 75 which is carried by the tubular mandrel 74 and extends internally into the top end of the cage 78 to a point below the dogs. The piston dog retainer 75 has external seals 76 and internal seals 76' which seal respectively in counter bore 73" of tubular bushing 73 and on tubular mandrel 74. The piston dog retainer 75 has openings 75' which are sufficiently large enough to receive dogs 72, said openings 75', which are located above the dogs 72 when the setting tool ST is assembled in the running position, are maintained in radial alignment with dogs 72 by means of key screw 79 extending through cage 78 into the longitudinal slot 75" in piston dog retainer 75. The piston dog retainer 75 is releasably and slideably retained to the tubular mandrel 74 by means of shear screw 79' which may be broken upon application of a predetermined amount of fluid pressure through port 83 in the tubular mandrel 74.

Until shear screws 79' are broken, the piston dog retainer's position on the tubular mandrel 74, extending into the cage 78 to a point below the dogs 72, releasably retains the dogs within and through windows 78' to the extent necessary for the dogs to engage annular groove 71 of setting collar 70. The coil tubing CT contained within the upper body 34 of the guide assembly GA may be connected to the setting tool ST by any suitable means such as by the thread connection 74" on the tubular mandrel 74 and the connector assembly CA which is well known in the art.

From the foregoing, it can be determined that when the setting tool ST of the coil tubing workstring CTWS is engaged in the running in position within the setting collar 70, relative longitudinal movement between the setting tool, which is part of the workstring/drillstring, and the setting collar is prevented since downward movement of the setting tool relative to the setting collar is prevented because of engagement of the dogs 72 in the annular groove 71 and upward movement of the setting tool relative to the setting collar is prevented because of engagement of shoulder 82 of the cage 78 with the lower shoulder 70' of the setting collar 70 and the engagement of shoulder 81' of the cage 78 with shoulder 81 of the tubular mandrel 74.

In operating the workstring/drillstring CTWS with this form of setting collar, the guide assembly GA of the present invention is connected to the coil tubing workstring CTWS and run into the well to engage the Anchor A as previously described with the conventional coupled pipe workstring version.

Weight or force is applied to bend the articulated inner tubular member 55 and the drilling tube CT to direct movement of the drilling tube and jet nozzle 60 thereon to positon the drilling tube CT and jet nozzle 60 laterally of the main cased earth bore to exit for performing the desired jetting operations.

Fluid pressure is applied at the earth's surface through the coil tubing workstring workstring/drillstring CTWS to release from the setting collar 70. The presure increases due to the restricted flow through the jet nozzle 60. When the pressure, entering port 83 of the setting tool ST, attains the desired proportions, the piston dog retainer 75 shifts downward relative to tubular mandrel 74 and cage 78 breaking shear screw 79 until openings 75' of piston dog retainer 75 moves adjacent dogs 72, permitting the dogs 72 to move from their engagement with annular groove 71 of setting collar 70 into said openings 75' of the piston dog retainer 75 to release the workstring/drillstring CTWS from the setting collar.

Weight or force may then be applied to the coil tubing workstring CTWS to displace the drilling tube CT supported thereby from within the guide assembly GA into the formation. If the piston dog retainer fails to shift and release the dogs for any reason, the setting tool ST and workstring/drillstring CTWS may alternately be mechanically released from the setting collar 70 by application of sufficient weight to the setting tool ST to break shear screws 80 which releasably connects the cage 78 to the tubular mandrel 74. Such action will permit downward movement of the tubular mandrel 74 and tubular bushing 73 relative to the cage 78 until the lower end 84 of the tubular bushing 73 contacts the upper end 78'' of the cage 78. Openings 75' in the piston dog retainer 75 will be positioned adjacent the dogs 72 permitting the same to move from engagement with the annular groove 71 of the setting collar 70. Weight or force may then be applied to the workstring/drillstring as described above.

The remaining operations to accomplish the desired jetting operations, or other operations of any type and subsequent retrieval of the drilling tube and jet nozzle into the guide asembly and to retrieve the guide assembly from the location where it was anchored are as previously described with the conventional coupled workstring version.

Fluid and or abrasives of any suitable type well known may be supplied to the upper end portion of the wellstring/drill string of either the coupled pipe form or the coil tubing form by any suitable means well known in the art.

Where ordinary, as opposed to lateral, jetting is to be performed, the articulations, windows in the internal and outer tubular members, and pivot connection therebetween may be omitted. The guide assembly can be anchored with any suitable surface, and the drilling or jetting tube exited, in a manner as previously described, from the lower end of the outer tubular member for jetting as desired. The jet nozzle 60 may be formed of any suitable material, such as carbide, when necessary.

The guide assembly may be used in operations other than jetting. For example, any suitable workstring for connecting with the guide assembly and for supporting and moving a tube or other type of member may be employed. An electrical conduit may be extended through the tube or mounted on a flexible member extending longitudinally of the guide assembly and moved to a remote or inaccessible location to provide a means of communicating with and/or seaching for survivors in a disaster, such as by way of example, a collapsed structure, a mining disaster and the like. Food or water may be provided through the tube.

The foregoing disclosure and description of the invention are illustrative thereof, and various changes in size, shape and materials as well as in details of the illustrated construction may be made without departing from the spirit of the invention.

What is claimed is:

1. An arrangement for releasably anchoring a guide assembly with an anchor to perform jetting operations including:

an orientation sleeve connected with the anchor and extending upwardly therefrom;

a releasable latch releasably supported on the guide assembly;

an anchor surface on the orientation sleeve; and a latch surface on said releasably supported latch for positioning with said orientation sleeve to releasably secure the guide assembly with said orientation sleeve.

2. The arrangement of claim 1 wherein:

said anchor surface comprises a recess on said orientation sleeve; and said latch surface comprises enlargements on said releasable latch.

3. The arrangement of claim 1 including:

a first surface on the guide assembly for maintaining said latch surface secured in said orientation sleeve; and a second surface on the guide assembly to retrieve the latch with the guide assembly from the orientation sleeve.

4. The arrangement of claim 3 wherein the guide assembly includes a latch mandrel and wherein said first surface and said second surface are on said latch mandrel.

5. The arrangement of claim 1 wherein said orientation sleeve includes:

a longitudinal bore there through with a recess therein;

a tubular body depending therefrom;

said tubular body having tapered surfaces thereon and a longitudinal bore extending through said tubular body;

tapered surfaces on said body;

said orientation sleeve terminating in an upper end with an inclined annular edge surface thereon and a guide assembly latch surface within said longitudinal bore of said orientation sleeve;

slip means supported adjacent said tapered surfaces on said tubular body for engagement with a surface to secure the anchor therewith; and lock means to maintain the anchor secured with the surface.

6. The arrangement of claim 5 wherein said releasable latch is releasably supported on the guide assembly by frangible means and wherein said releasable latch includes:

a latch body;

circumferentially spaced, longitudinally extending members on said latch body; and enlargements on said members for positioning within the recess in the orientation sleeve.

7. The arrangement of claim 5 wherein the recess is a slot and the guide assembly includes a surface for engaging in the slot of said orientaton sleeve.

8. The arrangement of claim 1 wherein the guide assembly includes an outer tubular member on which said releasable latch is releasably supported and an internal tubular member releasably supported on said outer tubular member.

9. The guide assembly of claim 8 wherein said outer tubular member includes:

a spline sub;

an orientation sub;

a retainer;

a latch mandrel; and a lower tubular body.

10. The guide assembly of claim 9 wherein:

said spline sub has external splines on one annular surface thereof, external threads on a second annular surface thereof, and internal threads on a third annular surface thereof;

said orientation sub engaged with said external splines on said one annular surface of said spline sub;

said retainer engaged with said external threads on said second annular surface thereof to releasably retain said orientation sub on said spline sub;

said latch mandrel engaged with said internal threads of said spline sub; and said lower tubular body connected, to said latch mandrel.

11. A guide assembly for use with an orientation sleeve to perform jetting operations including:

an internal tubular member;

a jetting tube having a jetting head thereon within said internal tubular member;

an outer tubular member supported on said internal tubular member for relative longitudinal movement therebetween; and a latch releasably supported on said outer tubular member for releasably securing the guide assembly with the orientation sleeve.

12. The guide assembly of claim 11 wherein said outer tubular member includes an orientation sub; and means to releasably secure said orientation sub of the guide assembly in any desired rotated position on said outer tubular member.

13. The guide assembly of claim 12 wherein said means to releasably secure said orientation sub on said outer tubular member comprises cooperating releasable surfaces on said outer tubular member and on said orientation sub engageable to secure said orientation sub in a desired rotated position on said outer tubular member; and means releasably connecting the orientation sub with the guide assembly whereby the orientation sub may be disconnected for disengaging said cooperating releasable surfaces on the outer tubular member and said orientation sub and then reconnected to position the orientation sub in any desired rotated position on said outer tubular member.

14. The guide assembly of claim 13 wherein said cooperating releasable surfaces comprise engageable keys and keyways on the outer tubular member and on said orientation sub.

15. The guide assembly of claim 11 including means to secure the guide assembly releasably with a surface.

16. A guide assembly for releasably connecting with a workstring/drill string for supporting a drilling tube with a jet nozzle on its lower end for jet drilling in a generally lateral direction relative to a main cased earth bore, said guide assembly including:

an internal tubular member with a lower end for receiving the drilling tube and jet nozzle therethrough;

an outer tubular member and having a lower end for receiving the drilling tube, jet nozzle and internal tubular member therethrough; and said inner tubular member pivotally connected adjacent its lower end to said outer tubular member adjacent its lower end.

17. The guide assembly of claim 16 wherein said outer tubular member is releasably supported on said internal tubular member.

18. The guide assembly of claim 16 wherein said inner tubular member includes an upper body thereon having an upper end and a lower end.

19. The guide assembly of claim 18 wherein:

the drill string includes a setting tool mandrel;

said upper body includes a setting collar adjacent said upper end thereof, and further including:

cooperating surfaces on said setting collar and said setting too mandrel for releasably engaging said internal tubular member with the drill string for inhibiting premature relative longitudinal movement therebetween.

20. The guide assembly of claim 19 wherein said cooperating surfaces on said setting tool mandrel and on said collar include:

a non-circular outer surface portion on said setting tool mandrel;

a setting nut in sliding, non-rotational relationship with said noncircular outer surface portion;

said setting nut having an annular outer surface thereon;

said setting nut having threads on said annular outer surface thereof;

and threads on said setting collar for threadedly engaging with said threads on said setting nut whereby the drill string may be released from said internal tubular member by rotation of the drill string relative to said internal tubular member and the drilling tube.

21. The guide assembly of claim 19 wherein said cooperating surfaces on said setting collar and said setting tool mandrel includes cooperating surfaces responsive to fluid pressure to disengage the drill string from the internal tubular member.

22. The guide assembly of claim 21 including additional cooperating surfaces responsive to manipulation of the workstring/drill string to disengage the drill string from the internal tubular member.

23. The guide assembly of claim 18 wherein said upper body has an internal diameter larger than the outside diameter of the drill string including couplings in the drill string.

24. The guide assembly of claim 18 wherein said upper body and the drill string have cooperating surfaces for releasably securing the drill string with said upper body and which permit the drill string to be disengaged from said upper body.

25. The guide assembly of claim 18 wherein said upper body includes a plurality of tubular members threadedly connected together by couplings.

26. The guide assembly of claim 18 wherein:

said upper body is of sufficient length to contain the .amount of drilling tube required to be displaced from the guide assembly for jetting into the earth's formation a desired extent; and wherein:

said upper body is of sufficient internal diameter to permit unresricted downward passage of the drill string therethrough.

27. The guide assembly of claim 16 including a swivel arrangement between the drilling tube and workstring to accommodate rotation of the workstring relative to the drilling tube.

28. The guide assembly of claim 27 wherein said swivel arrangement includes:

an annular shoulder on the workstring;

a swivel mandrel having an annular shoulder thereon for engaging with said annular shoulder on the workstring; and seal means between the workstring and the drilling tube.

29. The guide assembly of claim 28 wherein the drilling tube is connected with said swivel mandrel.

30. The guide assembly of claim 16 wherein said outer tubular member has a guide assembly latch surface thereon.

31. The guide assembly of claim 16 wherein the drill string is of a length no shorter than the extent of the jetting to be accomplished by the drilling tube and jet nozzle thereon.

32. The guide assembly of claim 16 wherein said inner and outer tubular members are configured to bend said internal tubular member and the drilling tube to form a generally curved path to exit the drilling tube from the guide assembly in a generally lateral direction relative to the main cased earth bore.

33. The guide assembly of claim 32 including cooperating surfaces on said internal tubular member and said outer tubular member to releasably lock said internal tubular member and the drilling tube in the curved path position.

34. The guide assembly of claim 16 wherein said internal tubular member includes:

an upper body having an upper and a lower end;

a guide kelly connected with said lower end of said upper body;

said guide kelly having an upper and a lower end;

a tubular member connected to said lower end of said guide kelly;

said tubular member having an upper and a lower end; and a straightening guide connected to said lower end of said tubular member.

35. A guide assembly for connecting with a well string, and for releasably securing in an anchor secured in a main cased earth bore against rotation relative to the casing to (1) lower a drilling tube with a jet nozzle thereon through a main cased earth bore to bend the guide assembly and drilling tube in the main cased earth bore or in an adjacent cavity to jet drill laterally of the main cased earth bore, and (2) extend the drilling tube and jet nozzle laterally relative to the main cased earth bore for jet drilling, said guide assembly including:

an internal tubular member including an upper body for releasably connecting to the well string;

at least one drilling tube supported by the well string and extending through said internal tubular member;

an outer tubular member partially surrounding and releasably supported on said internal tubular member;

a latch on said outer tubular member for releasably securing said outer tubular member with the anchor;

said outer tubular member having a lower end portion with a longitudinally extending face window and a longitudinally extending heel window on opposite sides of said lower end portion;

said internal tubular member having a lower end portion with articulations therein adjacent said heel window and face window;

said internal tubular member being pivotally connected to said outer tubular member adjacent said face window;

the well string, drilling tube and internal tubular member movable by force applied to move downwardly for bending said internal tubular member and drilling tube outwardly of said heel window and direct said internal tubular member lower end portion and drilling tube toward said face window; and cooperating surfaces on said upper body and well string releasable by energy to disengage the well string from said upper body for downward movement with said drilling tube to extend said drilling tube and jet nozzle thereon from said main cased earth bore through said face window to jet drill.

36. The guide assembly of claim 35 including variable means to predetermine the general lateral direction in which said drilling tube extends from the main cased earth bore.

37. The guide assembly of claim 36 wherein said variable means comprise engageable surfaces on said internal and outer tubular members to limit the downward stroke of the wellstring and drilling tube 38. The guide assembly of claim 37 including lock means on said internal tubular member and said outer tubular member to lock said drilling tube in the general direction in which it exits from the main cased earth bore.

39. The guide assembly of claim 38 wherein said lock means includes engageable surfaces on said internal and outer tubular members.

40. The guide assembly of claim 39 wherein said additional engageable surfaces comprise an annular groove on said internal tubular member and at least one spring loaded plunger on said outer tubular member.

41. A method for jetting in a desired azimuthal position by a jet head on a drilling tube supported by a guide assembly to be releasably secured with a surface comprising the steps of:

releasably engaging the guide assembly with the surface in the desired azimuthal position and against rotation relative to the surface; and manipulating the drilling tube to move the drilling tube and jet head thereon to exit at a preselected angle to perform drilling operations.

42. A method for jetting in a desired azimuthal direction generally laterally relative to a main cased earth bore by a jet nozzle on a drilling tube which drilling tube is supported by a guide assembly associated with a workstring and wherein the drilling tube extends from the main cased earth bore into a cavity comprising the steps of:

securing an anchor in the main cased earth bore against rotation relative to the casing;

engaging the guide assembly with the anchor in the desired azimuthal direction against rotation relative to the anchor; and manipulating the workstring to bend the drilling tube to exit at a selected angle and to then move the drilling tube and jet nozzle at the selected angle from the main cased earth bore for jetting the earth in the cavity in the desired azimuthal direction.

43. A method for directing jetting from a main cased earth bore by a jet nozzle on a drilling tube which is supported by a guide assembly associated with a workstring, comprising the steps of:

securing the guide assembly having a guide assembly latch surface thereon on an anchor in the main cased earth bore in the desired azimuthal direction to exit the drilling tube from the guide assembly in the desired azimuthal direction and generally in a lateral direction to jet at an angle relative to the main cased earth bore; and manipulating the workstring to bend the drilling tube to exit at a desired exit angle and to then move the drilling tube and jet nozzle thereon at the selected angle relative to the main cased earth bore for jetting in the desired azimuthal direction laterally relative to the main cased earth bore.

44. A method of securing a guide assembly by a workstring in an anchor secured in a main cased earth bore to exit a drilling tube with a jet nozzle thereon laterally from the main cased earth bore at a preselected exit angle and in a desired azimuthal direction by manipulating the work string, comprising the steps of:

connecting the workstring with the guide assembly; and lowering the workstring and guide assembly in the main cased earth bore to releasably secure the guide assembly with the anchor in the desired azimuthal direction against rotation relative to the main cased earth bore and against premature withdrawal therefrom.

45. A method of releasably securing a guide assembly with a guide assembly latch surface on an anchor secured in a main cased earth bore to position the guide assembly for exiting a drilling tube with a jet nozzle thereon from the guide assembly in a desired azimuth, comprising the steps of:

lowering a mechanism into the earth bore casing to determine the orientation of the guide assembly latch surface relative to a predetermined direction;

removing the mechanism from the earth bore casing; and assemblying the guide assembly so that when it is releasably secured with the guide assembly latch surface on the anchor, the guide assembly faces in the direction in which it is desired to exit the drilling tube and let nozzle thereon from the main cased well bore.

46. A method of positioning a guide assembly to point from a main cased earth bore having an anchor therein by using an outer tubular member to extend within the main cased earth bore, the outer tubular member having a heel window and face window on opposite sides thereof adjacent its lower end, an internal tubular member releasably supported by a drill string adjacent its upper end, the internal tubular member being pivotally connected adjacent its lower end to the outer tubular member adjacent the face window, the internal tubular member having an articulated portion adjacent the windows, a drilling tube within the internal tubular member, the drilling tube having a fluid jet-type drilling head at its lower end, the method comprising positioning the outer and internal tubular member with the drilling tube therein in the main cased earth bore, releasably securing the guide assembly against rotation in the anchor in the main cased earth bore, moving the drill string, internal tubular member and drilling tube relative to the outer tubular member to point the lower end of the internal tubular member and the drilling tube laterally from the main well bore.

47. A method of jetting in a direction from a main cased earth bore by securing a guide assembly against rotation in an anchor in the main cased earth bore by using an outer tubular member to extend within the main cased earth bore, the outer tubular member having a heel window and face window on opposite sides thereof adjacent its lower end, an internal tubular member releasably supported by a drill string adjacent its upper end, the internal tubular member being pivotally connected to the outer tubular member adjacent its lower end adjacent the face window, the internal tubular member having an articulated portion adjacent the face windows, a drilling tube within the internal tubular member, the drilling tube having a fluid jet-type drilling head at its lower end, the method comprising positioning the outer and inner tubular member with the drilling tube therein in the main cased earth bore, releasably securing the guide assembly against rotation in the anchor in the main cased earth bore, moving the drill string, internal tubular member and drilling tube relative to the outer tubular member to point the lower end of the internal tubular member and the drilling tube laterally from the main well bore.

48. A method for lateral jet drilling in any desired azimuthal direction and at a preselected exit angle relative to a main cased earth bore that has an anchor secured against rotation therein, wherein an internal tubular member with a drilling tube therein is releasably secured with the workstring and wherein an outer tubular member is releasably supported on the internal tubular member, comprising the steps of:

moving the workstring and internal tubular member with the drilling tube therein and the outer tubular member thereon into the main cased earth bore to secure the external tubular member with the anchor in a desired azimuthal direction;

moving the workstring, internal tubular member and drilling tube relative to the outer tubular member to direct the internal tubular member and drilling tube therein laterally of the external tubular member;

disconnecting the workstring from the internal tubular member; and moving the workstring down to move the drilling tube out of the internal tubular member in the preselected angle for jetting.

49. The method of claim 41, or 42 or 43 or 47 or 48 including the step of subjecting the drilling tube to straightening forces by a pivotally mounted straightening guide as it exits the internal tubular member.

50. The method of claim 41 or 42 or 43 or 47 or 48 including the step of supplying fluid under pressure to the drilling tube to exit in the desired azimuthal direction.

51. A guide assembly for releasably securing adjacent its upper end with a workstring that includes a drill string for supporting a drilling tube adjacent its upper end with a jet nozzle on its lower end for jet drilling relative to a main cased earth bore, said guide assembly including an internal tubular member for receiving the drilling tube therethrough, which internal tubular member is pivotally connected at its lower end with an outer tubular member that is releasably supported on the inner tubular member for securing with an anchor in the main cased earth bore to enable the workstring, drill string, internal tubular member and drilling tube means to be moved down and exit from the outer tubular member in a predetermined general lateral direction, the outer tubular member having an upper opening in its lower end portion through which said internal tubular member and drilling tube extend to form an arcuate path for directing the lower end of internal tubular member and jet nozzle thereon to face a lower opening in said outer tubular member for extending the drilling tube and jet nozzle through said lower opening for jet drilling in the predetermined general lateral direction.

52. A method of jetting in any desired azimuthal direction comprising the steps of:

releasably securing an outer tubular member of a guide assembly with an anchor to secure the guide assembly in a desired azimuthal direction against rotation relative to the anchor;

moving an internal tubular member of the guide assembly and a jetting tube thereon relative to the outer tubular member to bend to exit at a predetermined exit angle and perform jetting operations in the desired azimuthal direction.

53. The method of claim 52 including the steps of:

retracting the jetting tube into the internal tubular member from the desired azimuthal direction;

retracting the internal tubular member and the jetting tube into the outer tubular member; and releasing the outer tubular member from the anchor.

54. A method of jetting in any desired azimuthal direction employing an inner tubular member and an outer tubular member of a guide assembly comprising the steps of:

securing the outer tubular member of the guide assembly against rotation relative to an anchor surface;

moving the internal tubular member of the guide assembly and a jetting tube with a jetting head thereon relative to the outer tubular member to move the internal tubular member and jetting tube in a desired azimuthal position relative to the anchor and and to bend the jetting tube to a preselected exit angle; and moving the jetting tube and jetting head relative to the internal tubular member to perform jetting operations.

55. A guide assembly to perform an operation at a remote or inaccesible location including:

an internal tubular member;

an external tubular member releasably supported by said internal tubular member; and said internal tubular member pivotally connected with said external tubular member.

56. The guide assembly of claim 55 including an exit member supported for movement with the internal tubular member and means for varying the exit angle of said exit member.

57. The guide assembly of claim 56 wherein the exit member is a tube.

58. The guide assembly of claim 55 for anchoring with a surface including:

a latch releasably supported on the guide assembly;

a latch surface on said latch for engaging with the surface for releasably securing the guide assembly with the surface to perform the operation in a desired azimuthal direction.

59. The guide assembly of claim 55 wherein said outer tubular member includes an orientation sub; and means to releasably secure said orientation sub of the guide assembly in any desired rotated position on said outer tubular member.

60. A guide assembly for use with an anchor to perform operations in any desired azimuthal direction including:

an internal tubular member;

a tube within said internal tubular member;

an outer tubular member supported by said internal tubular member for relative longitudinal movement therebetween; and a latch releasably supported on said outer tubular member for releasably securing the guide assembly with the anchor in the desired azimuthal direction.

61. An arrangement for releasably anchoring a guide assembly with an anchor surface against rotation and longitudinal movement relative to the anchor surface comprising:

cooperating surfaces on the guide assembly and anchor surface to releasably lock the guide assembly in a predetermined azimuthal direction and against rotation relative to the anchor surface; and cooperating surfaces on the guide assembly and the anchor surface to releasably lock the guide assembly against longitudinal movement relative to the anchor surface.

62. A method of bending an internal tubular member from a location that is remote relative to the internal tubular member on which an outer tubular member is supported comprising the steps of:

pivotally connecting the internal tubular member with the outer tubular member;

releasably securing the outer tubular member against rotation and longitudinal movement; and applying a force to move the internal tubular member longitudinally relative to the outer tubular member to bend the internal tubular member.

63. The method of claim 62 including the step of retrieving the pivotally connected bent internal tubular member from the remote location by applying a force to withdraw the internal tubular member into the outer tubular member.

* * * * *